US008777355B2

(12) United States Patent
Kagata et al.

(10) Patent No.: US 8,777,355 B2
(45) Date of Patent: Jul. 15, 2014

(54) IMAGE FORMING APPARATUS AND IMAGE FORMING METHOD

(75) Inventors: Takayoshi Kagata, Shiojiri (JP); Tsuyoshi Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 13/410,564

(22) Filed: Mar. 2, 2012

(65) Prior Publication Data

US 2012/0223984 A1 Sep. 6, 2012

(30) Foreign Application Priority Data

Mar. 4, 2011 (JP) ..... 2011-047982

(51) Int. Cl.
*B41J 29/38* (2006.01)

(52) U.S. Cl.
USPC ..... 347/14

(58) Field of Classification Search
USPC ..... 347/6, 9, 15, 95, 100, 14
See application file for complete search history.

(56) References Cited

U.S. PATENT DOCUMENTS

| | | | | |
|---|---|---|---|---|
| 5,742,300 | A * | 4/1998 | Klassen | 347/9 |
| 2009/0244118 | A1* | 10/2009 | Kakutani | 347/6 |
| 2009/0244137 | A1* | 10/2009 | Kakutani | 347/12 |
| 2009/0244168 | A1* | 10/2009 | Kakutani | 347/21 |

FOREIGN PATENT DOCUMENTS

| | | | | |
|---|---|---|---|---|
| JP | 11-078204 | A | 3/1999 | |
| JP | 2010052248 | A * | 3/2010 | B41J 2/21 |

* cited by examiner

*Primary Examiner* — Julian Huffman
*Assistant Examiner* — Sharon A Polk
(74) *Attorney, Agent, or Firm* — Nutter McClennen & Fish LLP

(57) ABSTRACT

An image forming apparatus includes a head unit that ejects ink and a control unit that forms a metallic image by causing metallic ink that includes metallic particles to be ejected onto a medium from the head unit are provided, wherein the control unit changes the amount of the metallic ink that is ejected per unit area of the medium based on the gradation values of the pixels that configure the metallic image while causing the metallic image to have a predetermined width or greater.

6 Claims, 23 Drawing Sheets

IMAGE FORMING APPARATUS AND IMAGE FORMING METHOD

BACKGROUND

1. Technical Field

The present invention relates to an image forming apparatus and an image forming method.

2. Related Art

A printing apparatus that performs recording by ejecting a liquid from nozzles and landing ink drops (dots) on a medium is common. With such a printing apparatus, printing may be performed using metallic ink that includes metallic particles such as aluminum microparticles as a pigment other than general color ink (for example, each color ink of KCMY).

With metallic printing using metallic ink, since the balance between the metallic luster and the color tone of the printed matter changes according to the amount of metallic particles that are included in the metallic ink, it was difficult to realize metallic printing with a favorable metallic luster at the desired color tone.

On the other hand, in a case when metallic printing is performed using metallic ink that includes aluminum powder as the metallic particles, there is a method of performing printing so that the shape of the metallic image becomes substantially mesh-like. Furthermore, a printing method of performing an adjustment of the metallic luster by controlling the amount of the aluminum powder that is included in the printed matter (image) by changing the size of the mesh has been proposed (for example, JP-A-11-78204).

According to the printing method of JP-A-11-78204, it is possible to print a metallic image with a high image quality and a favorable metallic luster. However, with such a method, even if it is possible to adjust the metallic luster by changing the size of the mesh, it was not possible to adjust the gradations of the metallic image. For example, nothing is disclosed with regard to a method of changing the shading of portions of the metallic image or expressing gradations by a metallic color.

In such a manner, with the metallic printing of the related art, while it was possible to print an image with a metallic luster for certain gradations, it was not possible to freely change the gradation values of the metallic image while having a favorable metallic luster at the same time, and it was difficult to print a variety of images according to the tastes of users.

SUMMARY

An advantage of some aspects of the invention is that a free gradation expression of an image is realized while forming an image with a favorable metallic luster when performing metallic printing using metallic ink.

According to an aspect of the invention, there is provided an image forming apparatus including a head unit that ejects ink and a control unit that forms a metallic image by causing metallic ink that includes metallic particles to be ejected onto a medium from the head unit, wherein the control unit changes the amount of the metallic ink that is ejected per unit area of the medium based on the gradation values of the pixels that configure the metallic image while causing the metallic image to have a predetermined width or greater.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
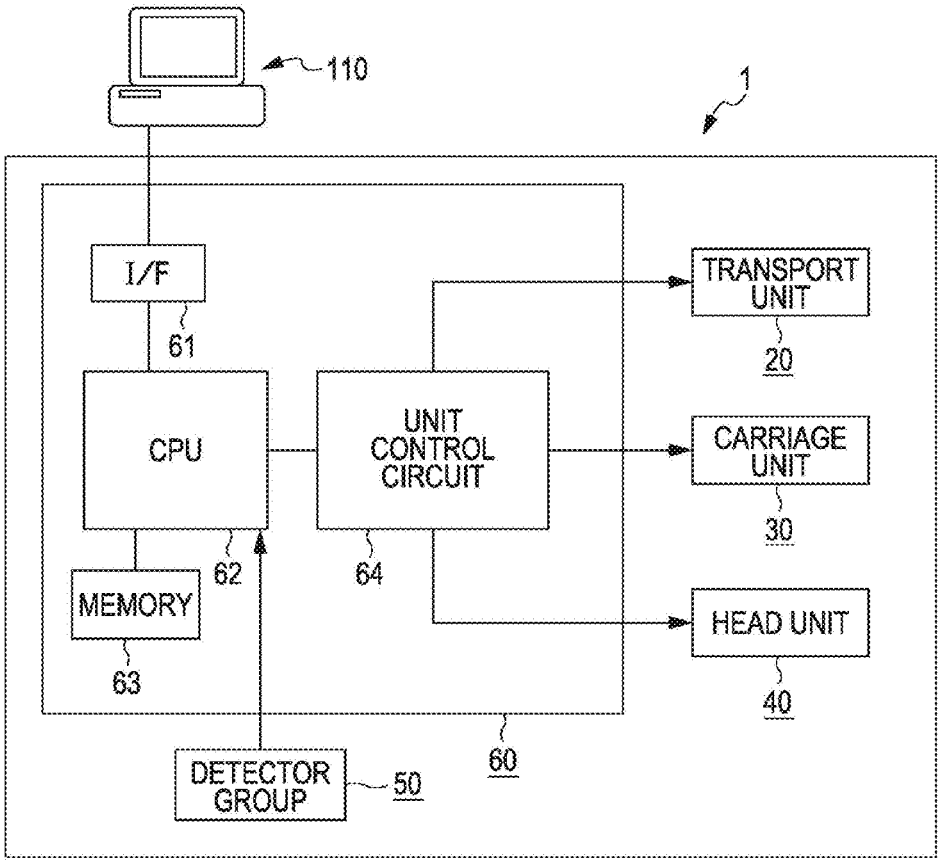
FIG. 1 is a block diagram that illustrates the overall configuration of a printer.

At least the following items become clear from the specification and the attached drawings.

An image forming apparatus that includes (A) a head unit that ejects ink and (B) a control unit that forms a metallic image by ejecting metallic ink that includes metallic particles from the head unit onto a medium are provided, wherein the control unit changes the amount of the metallic ink that is ejected per unit area of the medium based on the gradation values of the pixels that configure the metallic image while causing the metallic image to have a predetermined width or greater.

According to such an image forming apparatus, it is possible to realize a free gradation expression of an image while forming an image with a favorable metallic luster when performing metallic printing using metallic ink.

According to such an image forming apparatus, it is desirable that by thinning out the data of predetermined pixels out of the pixels that configure the metallic image from metallic image data that represents the metallic image, the control unit decrease the metallic ink amount that is ejected per unit area of the medium and increase the thinning amount of the data of the pixels for regions of the metallic image with low gradation values.

According to such an image forming apparatus, it is possible to change the way in which the metallic ink dots are thinned out and to freely express gradation in the image by thinning out the predetermined pixel data.

According to such an image forming apparatus, it is desirable that in a case when the data of the pixels is thinned out so that the metallic image becomes a striped pattern, the control unit thin out the data of the pixels so that the widths of the striped portions of the metallic image become thin or the intervals between the stripes of the metallic image to become wide for regions of the metallic image with low gradation values.

According to such an image forming apparatus, it is possible to perform gradation expression easily by adjusting the thinning pattern by adjusting the line widths of the stripes or the intervals between the stripes.

According to such an image forming apparatus, the control unit forms a color image by ejecting color ink from the head unit to the medium according to color image data that represents a color image, and in a case when there is an overlapping portion between the color image and the metallic image, it is desirable that the pixels for which the color ink is ejected out of the color image data and the pixels for which the metallic ink is ejected out of the metallic image data do not overlap.

According to such an image forming apparatus, it is possible to improve the overall printing speed even in a case when metallic color printing is performed by forming the metallic image and the color image at the same time.

According to such an image forming apparatus, it is desirable that the control unit thin out data of pixels that spill out from the outline of the metallic image out of the pixels that configure the metallic image from the metallic image data.

According to such an image forming apparatus, it is possible to perform high quality metallic printing of a metallic image in which the luster is maintained and jaggies and the like do not easily occur on the outline portion.

According to such an image forming apparatus, based on information that represents the angle between the line of view of the user and the image when the user views the formed metallic image, it is desirable that the control unit reduces the amount of metallic ink that is ejected per unit area in a region in which the medium and the line of view overlap when the angle is small.

According to such an image forming apparatus, it is possible to form a metallic image with a favorable luster and feel depending to the viewing angle.

Further, an image forming method of forming a metallic image on a medium by ejecting metallic ink that includes metallic particles and changing the amount of the metallic ink that is ejected per unit area of the medium based on the gradation values of the pixels that configure the metallic image while causing the metallic image to have a predetermined width or greater will be made clear.

Basic Configuration of Image Forming Apparatus

An ink jet printer (printer 1) will be described as an example of the image forming apparatus as an embodiment of the invention.

Configuration of Printer 1

Figure 2A:
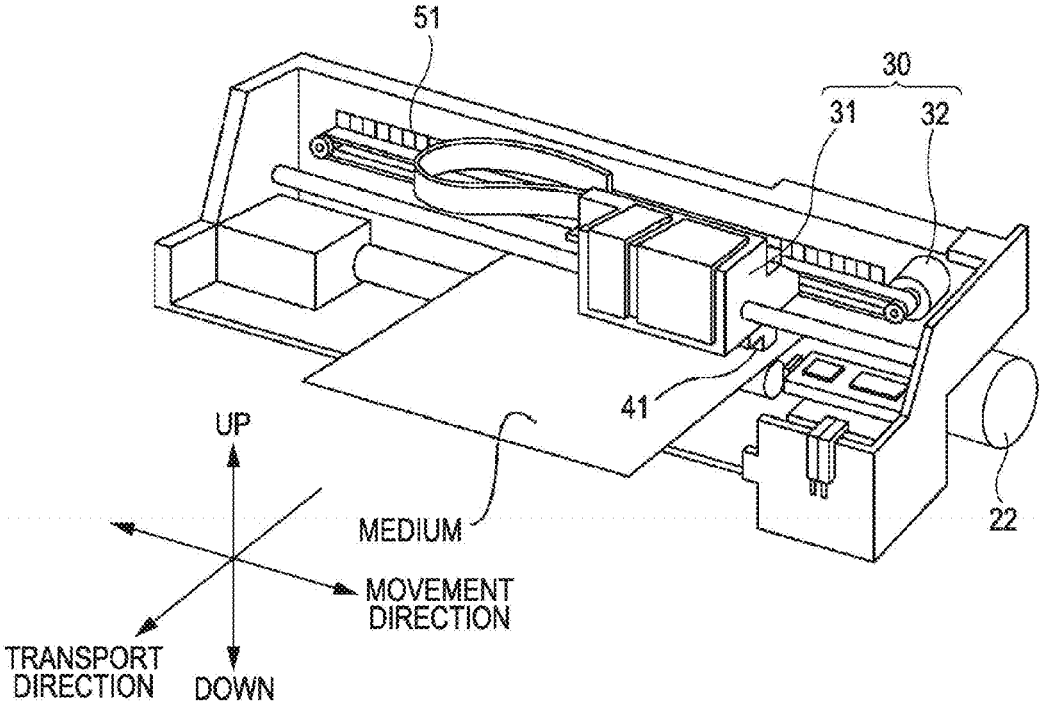
FIG. 2A is a diagram that describes the configuration of the printer.
Figure 2B:
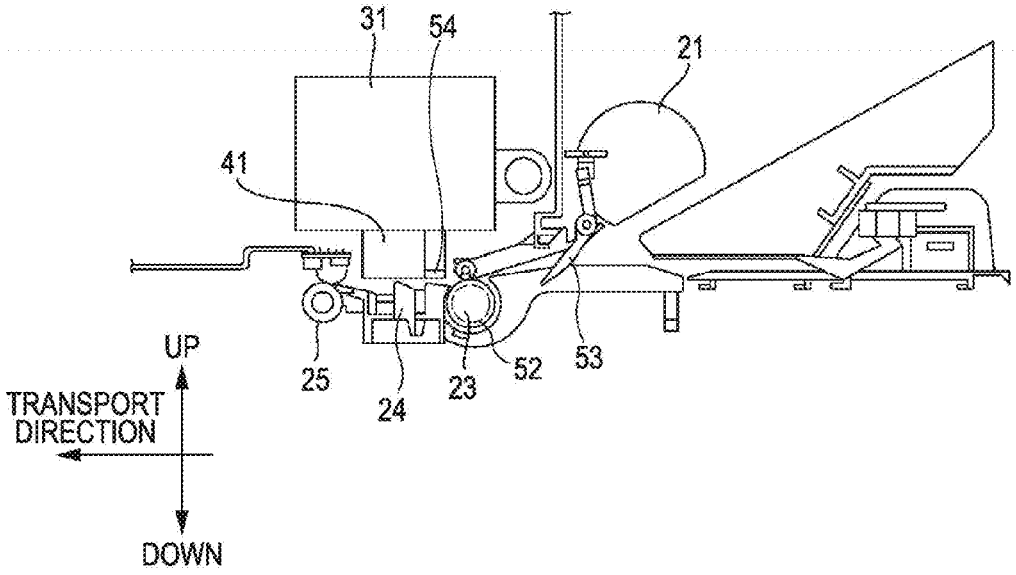
FIG. 2B is a side view diagram that describes the configuration of the printer of the embodiment.

FIG. 1 is a block diagram that illustrates the overall configuration of the printer 1. FIG. 2A is a diagram that describes the configuration of the printer 1 of the embodiment. FIG. 2B is a side view diagram that describes the configuration of the printer 1 of the embodiment.

The printer 1 is an image forming apparatus that forms (prints) characters and images on a medium such as paper, cloth, or film, and is connected to be communicable with a computer 110 that is an external apparatus.

A printer driver is installed on the computer 110. The printer driver is a program for displaying a user interface on the display apparatus and converting image data that is output from an application program into recording data. The printer driver is recorded on a recording medium (computer-readable recording medium) such as a flexible disk FD or a CD-ROM. Further, the printer driver is able to be downloaded onto the computer 110 via the Internet. Here, the program is configured by a code for realizing various functions.

The computer 110 is an image forming apparatus control unit for causing the printer 1 to print an image which outputs print data that corresponds to an image to be printed to the printer 1.

The printer 1 includes a transport unit 20, a carriage unit 30, a head unit 40, a detector group 50, and a controller 60. The controller 60 controls each unit based on print data that is received from the computer 110 that is the image forming apparatus control unit, and causes the image to be formed on a medium. The status within the printer 1 is monitored by the detector group 50, and the detector group 50 outputs the detection result to the controller 60. The controller 60 controls each unit based on the detection result that is output from the detector group 50.

Transport Unit 20

The transport unit 20 is for transporting the medium (for example, paper S and the like) in a predetermined direction (hereinafter referred to as the transport direction). Here, the transport direction is a direction that intersects the carriage movement direction. The transport unit 20 includes a paper feeding roller 21, a transport motor 22, a transport roller 23, a platen 24, and a paper ejection roller 25 (FIGS. 2A and 2B).

The paper feeding roller 21 is a roller for feeding the paper S that is inserted into a paper insertion opening into the printer. The transport roller 23 is a roller for transporting the paper S that is fed from the paper feeding roller 21 to a recordable region, and is driven by the transport motor 22. The actions of the transport motor 22 are controlled by the controller 60 on the printer side. The platen 24 is a member that supports the paper S that is being recorded from the back side. The paper ejection roller 25 is a roller that ejects the paper S to the outside, and is provided to the transport direction downstream side with respect to the recordable region.

Carriage Unit 30

The carriage unit 30 is for moving (also referred to as "scanning") a carriage 31 that is attached to the head unit 40 in a predetermined direction (hereinafter also referred to as the movement direction). The carriage unit 30 includes the carriage 31 and a carriage motor 32 (also referred to as a CR motor) (FIGS. 2A and 2B).

The carriage 31 is able to reciprocate in the movement direction (also referred to as the scan direction), and is driven by the carriage motor 32. The actions of the carriage motor 32 are controlled by the controller 60 on the printer side. Further, the carriage 31 retains a detachable cartridge that contains a liquid (hereinafter, also referred to as ink) that records images.

Head Unit 40

The head unit 40 ejects ink to the paper S. The head unit 40 includes a head 41 that includes a plurality of nozzles. The head 41 is provided on the carriage 31, and when the carriage 31 moves in the movement direction, the head 41 also moves in the movement direction. Furthermore, by ejecting ink intermittently while the head 41 is moving in the movement direction, dot lines (raster lines) are formed on the paper along the movement direction.

Figure 3:
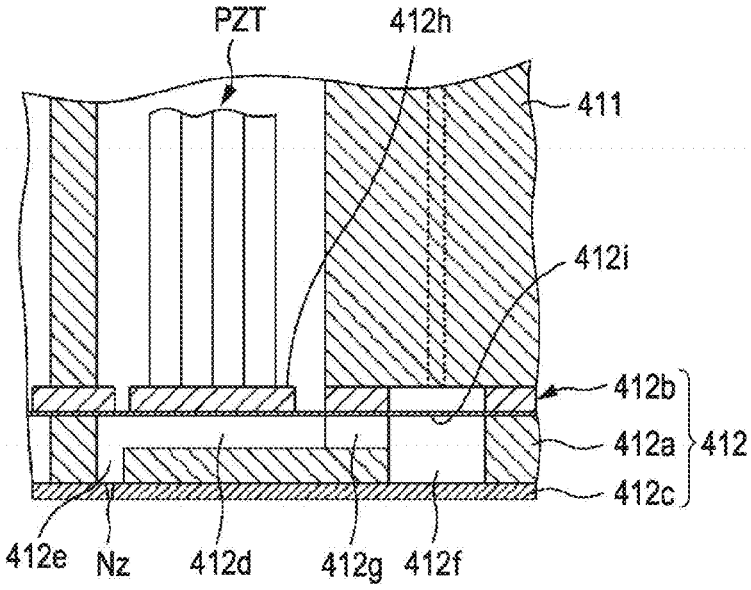
FIG. 3 is a cross-sectional diagram for describing the structure of a head.

FIG. 3 is a cross-sectional diagram that illustrates the structure of the head 41. The head 41 includes a case 411, a flow path unit 412, and a piezo element group PZT. The case 411 contains the piezo element group PZT, and the flow path unit 412 is joined to the lower face of the case 411. The flow path unit 412 includes a flow path formation plate 412*a*, an elastic plate 412*b*, and a nozzle plate 412*c*. A groove portion that is a pressure chamber 412*d*, a penetration portion that is a nozzle communication port 412*e*, a penetration portion that is a common ink chamber 412*f*, and a groove portion that is an ink supply path 412*g* are formed on the flow path formation plate 412*a*. The elastic plate 412*b* includes an island portion 412*h* to which the distal end of the piezo elements PZT is joined. An elastic region by an elastic film 412*i* is formed in the surroundings of the island portion 412*h*. Ink that is pooled in ink cartridges is supplied to the pressure chamber 412*d* that corresponds to each nozzle Nz via the common ink chamber 412*f*. The nozzle plate 412*c* is a plate on which the nozzles Nz are formed.

The piezo element group PZT includes a plurality of comb-shaped piezo elements (driving elements). There are as many piezo elements as there are nozzles Nz. When a driving signal COM is applied to the piezo elements by a wiring substrate (not shown) on which a head control unit HC and the like are mounted, the piezo elements expand and contract in the vertical direction according to the electric potential of the driving signal COM. When the piezo elements expand and contract, the island portion 412*h* is pushed to the pressure chamber 412*d* side or pulled in the opposite direction. At this time, ink droplets are ejected from the nozzles by the pressure in the pressure chamber 412*d* increasing or decreasing by the elastic film 412*i* in the surroundings of the island portion 412*h* deforming.

Figure 4:
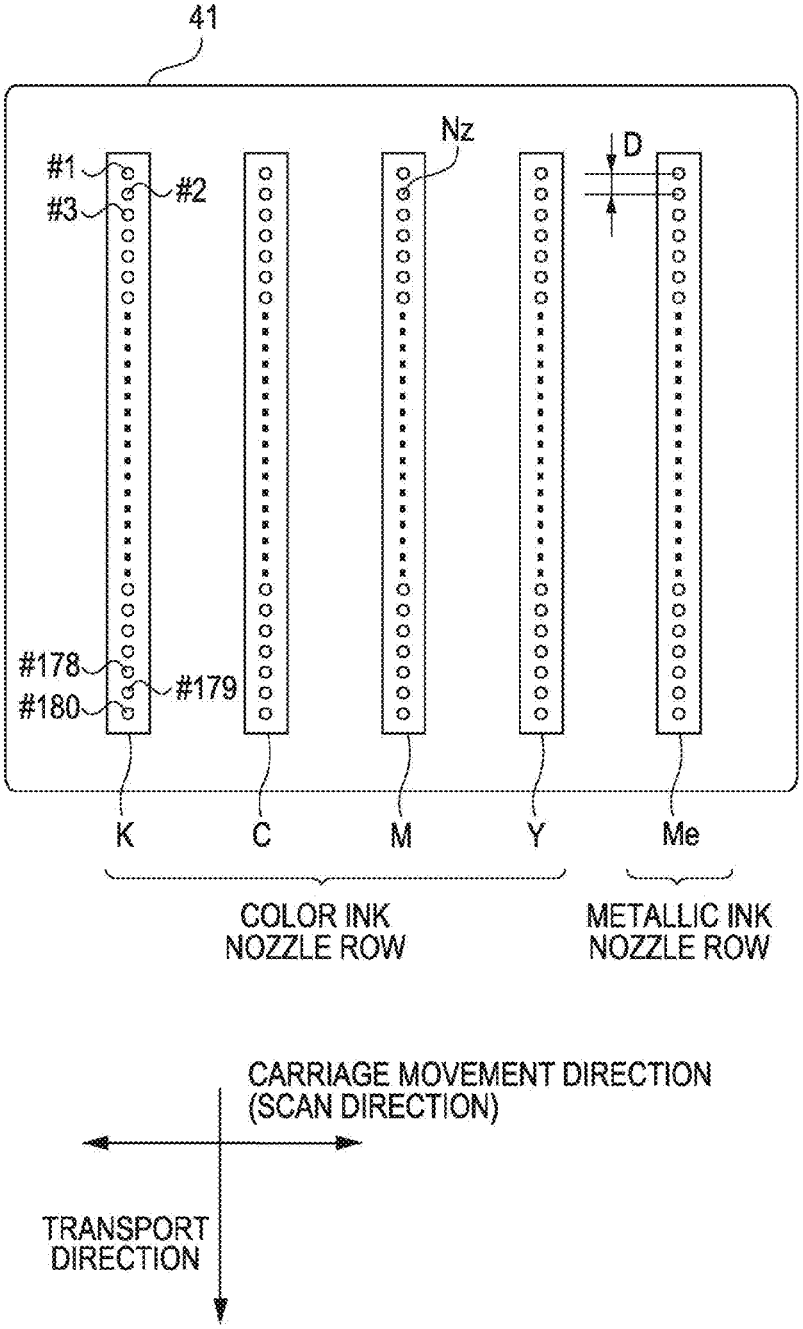
FIG. 4 is an explanatory diagram of nozzles Nz that are provided on the head.

FIG. 4 is an explanatory diagram of the nozzles Nz that are provided on the lower face (nozzle face) of the head 41. A color ink nozzle row composed of a yellow nozzle row Y that ejects yellow ink, a magenta nozzle row M that ejects magenta ink, a cyan nozzle row C that ejects cyan ink, and a black nozzle row K that ejects black ink, and a metallic ink nozzle row Me that ejects metallic ink are formed on the nozzle face. As illustrated in FIG. 4, each of the nozzle rows KCMY and Me are configured by the nozzles Nz that are ejection portions for ejecting the ink of each color being arranged in the transport direction with a predetermined interval D. Each nozzle row respectively includes 180 nozzles Nz from #1 to #180. Here, the actual number of nozzles in each nozzle row is not limited to 180, and for example, the number of nozzles may be 90 or 360. Further, in FIG. 4, although each nozzle row is arranged parallel along the transport direction, a configuration in which each nozzle row is arranged in a column along the transport direction is also possible. Further, rather than including one nozzle row for each color of KCMY-Me, a configuration in which each color respectively includes a plurality of nozzle rows is also possible.

Detector Group 50

The detector group 50 is for observing the status of the printer 1. The detector group 50 includes a linear encoder 51, a rotary encode 52, a paper detection sensor 53, an optical sensor 54, and the like (FIGS. 2A and 2B).

The linear encoder 51 detects the position of the carriage 31 in the movement direction. The rotary encoder 52 detects the rotation amount of the transport roller 23. The paper detection sensor 53 detects the position of the distal end of the paper S that is being fed. The optical sensor 54 detects the presence of the paper S that is positioned opposite by a light emitting unit and a light receiving unit that are attached to the carriage 31, and for example, is able to detect the width of the paper by detecting the position of the end portion of the paper while moving. Further, the optical sensor 54 is also able to detect the distal end (end portion on the transport direction downstream side, also referred to as the upper end) or the back end (end portion on the transport direction upstream side, also referred to as the lower end) of the paper S depending on the situation.

Controller 60

The controller 60 is a control unit for performing control of the printer. The controller 60 includes an interface unit 61, a CPU 62, a memory 63, and a unit control circuit 64 (FIG. 1).

The interface unit 61 performs transceiving of data between the computer 110 that is an external apparatus and the printer 1. The CPU 62 is a calculation process apparatus for performing overall control of the printer 1. The memory 63 is for securing a region in which to accommodate programs of the CPU 62, work regions, and the like, and is configured by a storage element such as a RAM or an EEPROM. Furthermore, the CPU 62 controls each unit of the transport unit 20 via the unit control circuit 64 according to a program that is accommodated in the memory 63.

Printing Actions of Printer

The printing actions of the printer 1 will be briefly described. The controller 60 receives a print command from the computer 110 via the interface unit 61, and performs a paper feeding process, a dot formation process, a transport process, and the like by controlling each unit.

The paper feeding process is a process of supplying the paper to be printed into the printer and positioning the paper at the print start position (also referred to as the ready position). The controller 60 rotates the paper feeding roller 21 and sends the paper to be printed to the transport roller 23. Next, the transport roller 23 is rotated, and the paper that is sent from the paper feeding roller 21 is positioned at the print start position.

The dot formation process is a process of forming dots on paper by intermittently ejecting ink from a head that moves along the transport direction (scan direction). The controller 60 moves the carriage 31 in the movement direction and ejects ink from nozzle rows that are provided on the head 41 based on the print data while the carriage 31 is being moved. When the ejected ink droplets land on the paper, dots are formed on the paper and dot lines composed of a plurality of dots along the movement direction are formed on the paper.

The transport process is a process of moving the paper along the transport direction relative to the head. The controller 60 transports the paper in the transport direction by rotating the transport roller 23. By such a transport process, the head 41 becomes able to form dots at positions that are different from the positions of the dots that are formed by the earlier dot formation process.

The controller 60 repeats the dot formation process and the transport process in an alternating manner until data to be printed runs out, and gradually prints images configured by dot lines on the paper. Furthermore, when the data to be printed runs out, the paper is ejected by rotating the paper ejection roller 25. Here, the determination of whether or not to perform paper ejection may be based on a paper ejection command included in the print data.

The same process is repeated in a case when printing is to be performed on the next sheet of paper, and the printing action is ended in a case when printing is not to be performed.

As the printing actions of the printer 1, there is "unidirectional printing" in which ink droplets are ejected from the nozzles during the outgoing movement of moving from the right side (home position) to the left side in the movement direction (scan direction) and ink droplets are not ejected from the nozzles during the returning movement when the head 41 moves from the left side to the right side and "bidirectional printing" in which ink droplets are ejected from the nozzles during both the outgoing movement and the returning movement. The printing method described in the embodiment is compatible with both printing actions of "unidirectional printing" and "bidirectional printing".

Metallic Ink Used in Printing

The metallic ink includes silver particles, aluminum particles, and the like as metallic particles. It is possible to obtain bright metallic luster on the print face with metallic ink that includes aluminum particles. However, aluminum particles oxidize easily, and there is a concern that the print face becomes whitened over time. On the other hand, with metallic ink that includes silver particles, while there are problems that the color of the metallic ink tends to become dark compared to ink that includes aluminum particles and the cost is high, silver particles do not easily oxidize and have the characteristic of being excellent in stability. Although the metallic ink to be used during printing may be selected according to the needs of the print, printing using metallic ink that includes silver particles will be described in the present specification. Here, according to the printing method of each of the embodiments described below, it is also possible to resolve the problems of the cost, the darkness of the color, and the like of using such silver particles.

As the solvent of the metallic ink, pure water or ultrapure water such as deionized water, ultrafiltered water, reverse osmosis water, and distilled water is used. There may be ions and the like in the water as long as the dispersal of the metallic particles is not impeded. Further, surfactants, polyalcohols, pH adjusting agents, resins, colorants, and the like may be included as necessary.

The silver particles that are included in the ink composition are particles with silver as the principal component. The silver particles may include, for example, other metals, oxygen, carbon, and the like as accessory components. The purity of the silver within the silver particles may be, for example, equal to or greater than 80%. The silver particles may be an alloy of silver and another metal. Further, the silver particles within the ink composition may exist in a colloidal (particle colloidal) state. In a case when the silver particles are dispersed in a colloidal state, the dispersion becomes more favorable, and for example, contributes to an improvement in the stability of the ink composition.

A particle diameter d90 of the particle diameter accumulation curve of the silver particles is 50 nm to 1 μm. Here, the particle diameter accumulation curve is a type of curve that is obtained by statistically processing the result of performing a measurement that is able to ascertain the particle diameter and the number of particles that are present with regard to the silver particles that are dispersed in a liquid such as an ink composition. In the particle diameter accumulation curve in the specification, the horizontal axis is the particle diameter and the vertical axis is the value (integrated value) of the particle mass (product of the volume, the particle density, and the number of particles when the particles are considered to be spheres) which is integrated from particles with small diameters to particles with large diameters. Furthermore, the particle diameter d90 refers to the value of the horizontal axis when the vertical axis is standardized (total mass of measure particles is 1) and the value of the vertical axis becomes 90% (0.90), that is, the particle diameter. Here, the diameters of the silver particles in such a case may be the diameters of the silver particles themselves, or may be the diameters of the particle colloids in a case when the silver particles are dispersed in a colloidal form.

The particle diameter accumulation curve of the silver particles is able to be ascertained, for example, by using a particle diameter distribution measurement apparatus based on a dynamic light scattering method. The dynamic light scattering method irradiates the dispersed silver particles with a laser beam and observes the scattered light with a photon detector. Generally, the dispersed silver particles are usually in Brownian motion. The speed of the motion of the silver particles is greater for particles with large particle diameters, and less for particles with small particle diameters. If a laser beam is irradiated on silver particles in Brownian motion, the swaying that corresponds to the Brownian motion of each silver particle is observed in the scattered light. It is possible to ascertain the diameter of the silver particles and the frequency (number) of the silver particles corresponding to the diameter by measuring the swaying, ascertaining the autocorrelation function by a photon correlation method or the like, and using cumulant method and histogram method analysis and the like. In particular, a dynamic light scattering method is suited to samples that include silver particles of a submicron size, and it is possible to obtain the particle diameter accumulation curve relatively easier by a dynamic light scattering method. Examples of particle diameter distribution measurement apparatuses based on a dynamic light scattering method include, for example, Nanotrack UPA-EX150 (manufactured by Nikkiso Co., Ltd.), ELSZ-2, DLS-8000 (both manufactured by Otsuka Electronics Co., Ltd.), and LB-550 (manufactured by Horiba, Ltd.).

Metallic Image

The metallic image is formed by forming many metallic ink dots by ejecting the metallic ink described above onto a medium from a metallic ink nozzle row that is provided on the head 41. In normal metallic printing, metallic ink dots are formed for all pixels that configure the metallic image. That is, the metallic image is formed by daubing over with metallic ink. However, with the embodiment, printing of a metallic image with a favorable metallic luster is realized by adjusting the amount of metallic particles (amount of metallic ink) that are present on the medium by thinning out the metallic ink dots on some of the pixels.

Thinning Out of Metallic Image

Figure 5A:
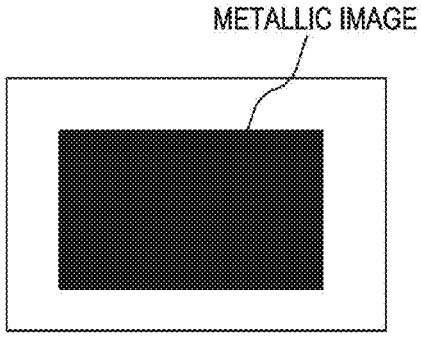
FIG. 5A is a diagram that represents the original image of a metallic image before dot thinning.
Figure 5B:
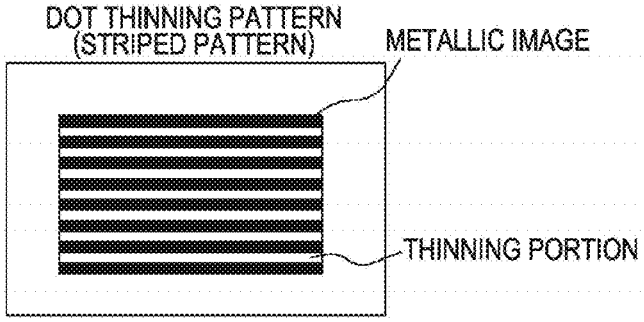
FIG. 5B is a diagram that illustrates an example of an image pattern that is printed in a case when dots are thinned out so that the metallic image becomes a striped pattern.
Figure 5C:
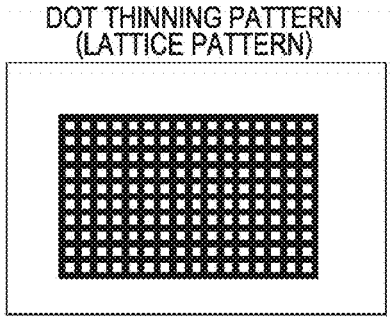
FIG. 5C is a diagram that illustrates an example of an image pattern that is printed in a case when dots are thinned out so that the metallic image becomes a lattice pattern.
Figure 5D:
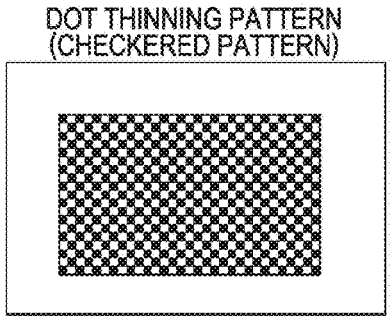
FIG. 5D is a diagram that illustrates an example of an image pattern that is printed in a case when dots are thinned out so that the metallic image becomes a checkered pattern.

Diagrams that describe examples of dot thinning of a metallic image are illustrated in FIG. 5A and FIGS. 5B to 5D. FIG. 5A is a diagram that represents the original image of a metallic image before dot thinning. FIG. 5B is an example of an image pattern that is printed in a case when dots are thinned out so that the metallic image of FIG. 5A becomes a striped pattern. FIG. 5C is an example of an image pattern that is printed in a case when dots are thinned out so that the metallic image of FIG. 5A becomes a lattice pattern. FIG. 5D is an example of an image pattern that is printed in a case when dots are thinned out so that the metallic image of FIG. 5A becomes a checkered pattern. Here, in order for the thinning patterns to be easier to understand in FIGS. 5B to 5D, the dot thinning widths and intervals are made somewhat larger than is actually the case so that the dot thinner patterns are easier to recognize.

The image data of the original image at the print start point is instructed so that dots are to be formed on all pixels of a region that configures the metallic image. That is, as illustrated in FIG. 5A, printing is started based on data in which a rectangular shape is formed by daubing over with the metallic ink. The printer driver prints the metallic image of the state in which dots are thinned out as shown in FIGS. 5B to 5D by generating metallic print data that represents the pixels onto which the metallic ink is to be ejected and pixels onto which the metallic ink is not to be ejected by thinning out the data of predetermined pixels. Here, the thinning patterns of the dots may be patterns other than those in FIGS. 5B to 5D. The method of generating the print data will be described later.

When printing a metallic image, if printing is performed by daubing altogether as in FIG. 5A, there is too much metallic ink on the medium, and the number of metallic particles that are included in the ink becomes excessive. In such a state, the entirety of the formed metallic image appears dark, and it is difficult to obtain an image with a favorable color tone.

On the other hand, by adjusting the amount of the metallic particles that are included in the image by thinning out a portion of the dots from the image to be printed as illustrated in FIGS. 5B to 5D, it becomes possible to form a metallic image with a favorable color tone.

On the other hand, in order to maintain the metallic luster of a metallic image, there must be a certain amount of metallic particles. That is, there is a need for a minimum amount of metallic ink dots which is needed to express a metallic luster by reflecting light. Therefore, if the thinning amount is too great when thinning out the metallic ink dots from the metallic image, there are not enough metallic ink dots, the metallic luster becomes insufficient, and the image quality of the metallic image deteriorates.

For example, in a case when thinning out the dots so that the metallic image becomes a striped pattern as in FIG. 5B, if the widths of the striped portions of the metallic image after dot thinning becomes thinner than a predetermined width, a sufficient metallic luster is not obtained. Specifically, if the line widths of the striped portions become thinner than 1 mm, a favorable metallic luster is not obtained. Therefore, when thinning out dots from the metallic image, it is necessary to thin out the dots so that regions (range within which metallic ink dots are formed) with at least 1 $mm^2$ are secured.

First Embodiment

In the first embodiment, a free gradation expression with a metallic luster is realized by thinning out the metallic ink dots when forming a metallic image. Here, in metallic printing, while a color image by color ink (each color ink of black (K), cyan (C), magenta (M), and yellow (Y)) may be formed at the same time, in the embodiment, there are no overlapping portions between the metallic image and the color image, which are respectively formed individually.

In a case when the dots are thinned out by the thinning patterns illustrated in FIGS. 5B to 5D described above, since the dots are thinned out at a fixed ratio for the entire region of the metallic image, the metallic image is printed as an image with even density. However, in a case when there is gradation expression such as portions with different shading in the metallic image that is the actual printing target, the dot thinning ratio must be changed in portions. That is, with a method of thinning out the dots at a fixed ratio as illustrated in FIG. 5B and the like, it is not possible to express the gradations. Therefore, according to the embodiment, a free gradation expression in the metallic image is realized by changing the dot thinning intervals and dot thinning widths for some portions.

Image Processing of Metallic Image

Figure 6:
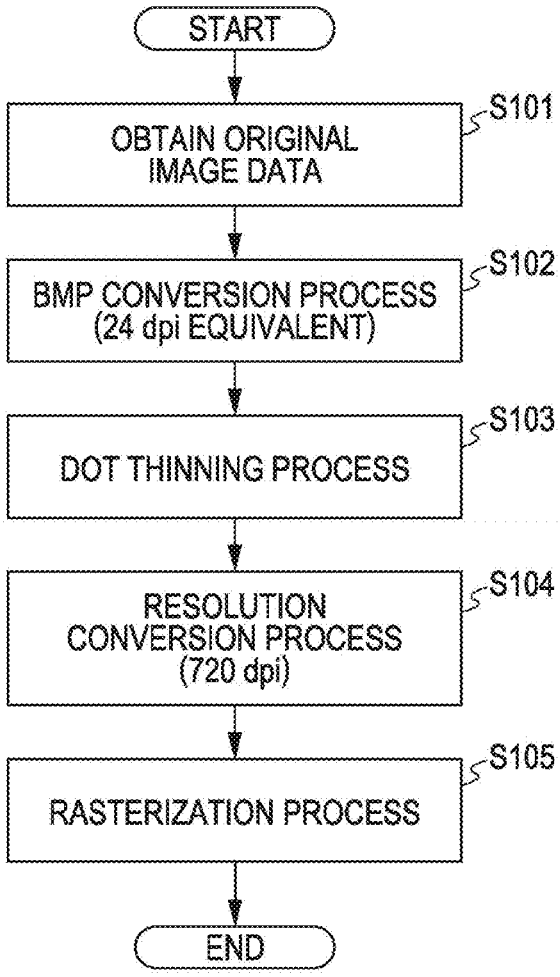
FIG. 6 is a diagram that represents the flow of image processing of the metallic image according to a first embodiment.

A specific image processing method when performing metallic printing will be described. The flow of image processing of the metallic image according to the first embodiment is illustrated in FIG. 6. According to the embodiment, image processing is performed by executing each of the processes of S101 to S105. Each process is executed based on an instruction from a printer driver that is installed on the computer 110.

The printer driver receives data of an original image of the metallic image from an application program and outputs the data into print data of a format that the printer 1 is able to interpret. The print data includes data (pixel data) that represents the amount of ink that is ejected for each pixel, and an image composed of many ink dots is formed by causing ink dots to be ejected onto the positions of each pixel from the head unit 40 of the printer 1 according to the print data.

Here, the printer driver may be installed on the controller 60 of the printer 1, and image processing may be performed by the printer 1.

When converting the data of the original image into print data, the printer driver performs a bitmap conversion process, a resolution conversion process, a rasterization process, and the like. Furthermore, the metallic ink dots are thinned out while the thinning rate of the dots is changed according to the gradation value of the original image data by a data generation process (S103) described later. The various processes that are performed by the printer driver will be described below in detail.

Before the start of printing, first, the computer 110 and the printer 1 are connected (refer to FIG. 1), and a printer driver that is stored on a CD-ROM that is provided with the printer 1 (or a printer driver that is downloaded from the home page of the printer manufacturer) is installed on the computer 110. The printer driver is provided with a code for the computer 110 to execute each of the processes of FIG. 6. Here, as described above, it is also possible to install the printer driver on the controller 60 of the printer 1.

When the user instructs printing from the application program and printing is started, the printer driver is invoked, the image data (original image data) that is the printing target is received from the application program (S101), and a bitmap (BMP) conversion process is performed on the image data (S102).

The bitmap conversion process (S102) is a process of converting image data of a vector format which is received from the application program into image data of a bitmap (BMP) format for image data composed of text data, image data, and the like so that each of the processes described later becomes easier to be performed at the pixel unit. At this time, bit map data is generated with a resolution of 1 mm×1 mm so that the minimum unit of regions on which metallic images are formed becomes a size that is approximately 1 $mm^2$. Such a 1 $mm^2$ region is defined as a virtual pixel. Here, the resolution may be not exactly 1 mm×1 mm but one pixel of a virtual pixel is a region of a similar size to 1 $mm^2$. For example, a virtual pixel may be a size such as 24 dpi×24 dpi.

As described above, in order to secure a favorable metallic luster for the metallic image, it is necessary to form a metallic image of a region of a size that is a minimum of approximately 1 $mm^2$. Therefore, the minimum unit at which the metallic ink dots are ejected is set to a virtual pixel of 1 mm×1 mm. In so doing, it becomes possible to form a metallic image with widths that are at least 1 mm, and the formed metallic image reliably has metallic luster.

Here, the image data after the bitmap conversion process is configured by the data of gradations (for example, 256 gradations) represented by the metallic (Me) color space.

After the bitmap conversion process (S102), the printer driver performs a thinning data generation process (S103) based on the gradation values of the original image data. The thinning data generation process is a process of generating image data in a state in which the dots are thinned out as in FIGS. 5B and 5C, and the thinning ratios of the dots are changes according to the gradation values of the regions that are the thinning targets. That is, by thinning out some of the dots (data for forming the dots) of many virtual pixels (regions of 1 $mm^2$) that configure the metallic image, data that shows the pixels onto which the metallic ink is ejected and pixels onto which the metallic ink is not ejected is generated. A specific method of the thinning data generation process (S103) will be described later.

Here, with image data after the thinning data generation process, data of 1 bit or 2 bits corresponds to each 1 mm×1 mm virtual pixel, and the image data becomes data that shows the formation situation (presence of dots, size of dots) of metallic ink dots in each virtual pixel (region of 1 $mm^2$).

A resolution conversion process (S104) is performed on image data for which thinning data generation process (S103) is complete.

The resolution conversion process (S104) is a process of converting the image data to the resolution (print resolution) of when printing is actually performed. In the embodiment, metallic image data with a resolution of approximately 24×24 dpi is generated by the bitmap conversion process (S102). However, if printing is performed at a resolution of 24×24 dpi, the image becomes very coarse. In particular, in a case when a color image is printed at the same time, the color image is printed with a finer resolution (for example, 720×720 dpi). There is therefore a need to convert metallic image data with a resolution of 24×24 dpi into a resolution of when the metallic image data is actually printed. For example, in a case when the actual print resolution is designated to be 720×720 dpi, image data with a resolution of 24×24 dpi is converted into data with 720×720 dpi.

Figure 7A:
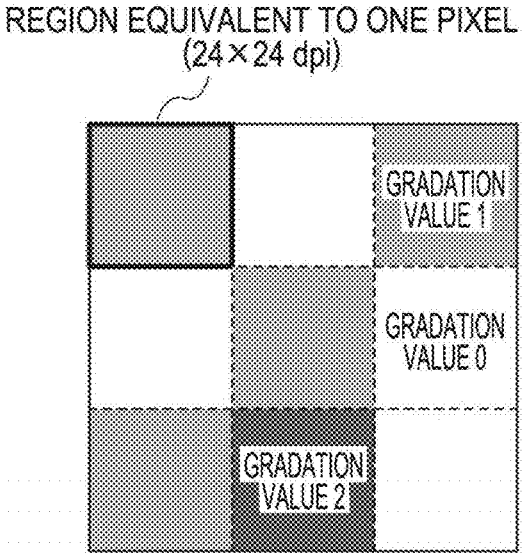
FIGS. 7A and 7B are diagrams that describe the outline of resolution conversion.
Figure 7B:
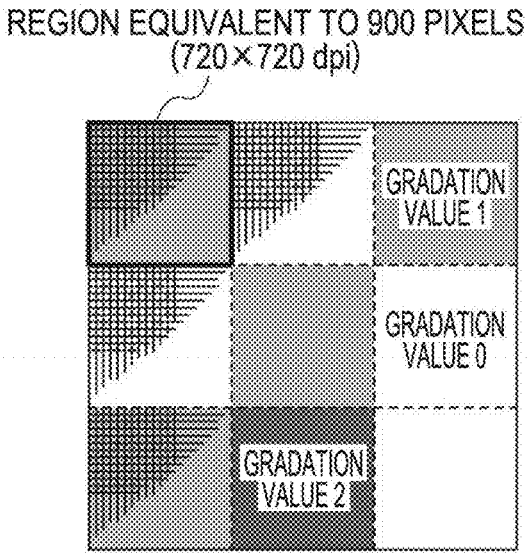

Diagrams for describing the outline of the resolution conversion are illustrated in FIGS. 7A and 7B. FIG. 7A is an example that represents an image of a region for nine pixels that are shown with a resolution of 24×24 dpi. The regions that are demarcated by broken lines respectively represent a pixel (virtual pixel), and such a pixel has a size of approximately 1 $mm^2$. Further, the lightly colored pixels represent pixels with a gradation value of 1, the darkly colored pixels represent pixels with a gradation value of 2, and the uncolored pixels represent pixels with a gradation value of 0. The data after the thinning data generation process is in the state illustrated in FIG. 7A.

FIG. 7B is an example in which the data for nine pixels represented by FIG. 7A is converted into a resolution of 720×720 dpi. When 24×24 dpi is converted into 720×720 dpi, the virtual pixel for one pixel becomes the print pixels for 900 (=30×30) pixels. Furthermore, all of the pixel data for the 900 pixels that are converted from one pixel of the virtual pixel represents the same pixel data. For example, in the regions surrounded by a thick line at the top left of FIGS. 7A and 7B, the region for one pixel (FIG. 7A) becomes the region for 900 pixels (FIG. 7B) by resolution conversion. Furthermore, the gradation values for all of the pixel data for the converted 900 pixels become 1. In so doing, an image with a resolution of 720×720 dpi and the gradation value 1 is printed on a region of a size that is approximately 1 $mm^2$.

Finally, the printer driver performs a rasterization process (S105). The rasterization process is a process that changes the order of the pixel data on the image data into the data order by which to be transferred to the printer 1. For example, the pixel data is reordered according to the order of the nozzles of the metallic ink nozzle row. The printer driver then generates print data by adding control data for controlling the printer 1 to the pixel data, and transmits the print data to the printer 1.

The printer 1 performs a printing action according to the received print data. Specifically, the controller 60 of the printer 1 forms an image to be formed on a medium by controlling the head unit 40 according to the pixel data of the print data and causing metallic ink to be ejected from each of the nozzles that are provided on the head 41 while transporting the medium by controlling the transport unit 20 and the like according to the control data of the received print data.

Details of Thinning Data Generation Process (S103)

Details of the thinning data generation process (S103) will be described. As described above, in the embodiment, data in which the dots are thinned out in units of virtual pixels is generated for virtual pixels that configure the metallic image, and printing is performing using such data. In so doing, a metallic image in which a free gradation expression is realized is formed with a favorable metallic luster by adjusting the amount of metallic ink that is ejected onto each virtual pixel. Accordingly, it is necessary to generate data that thins out metallic ink dots from predetermined virtual pixels out of the virtual pixels onto which metallic ink dots are planned to be ejected. Therefore, the printer driver specifies the pixels that are the thinning targets for the virtual pixel data of the metallic image which is the printing target and generates data in a state in which the dots are actually thinned out.

Figure 8:
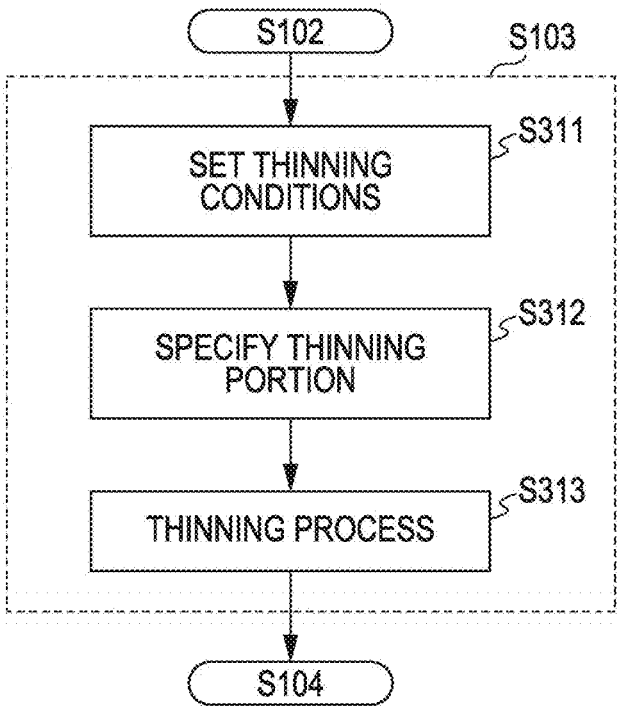
FIG. 8 is a diagram that represents the flow of a thinning data generation process according to embodiment.

A specific method of the thinning data generation process in a case when the thinning pattern becomes the horizontal striped pattern illustrated in FIG. 5B will be described. The flow of the thinning data generation process is illustrated in FIG. 8. The thinning data generation process (S103) is performed by sequentially executing the processes of S311 to S313.

S311: Setting of Thinning Conditions

First, the thinning pattern of the metallic ink dots is determined by the user. For example, the thinning patterns of FIGS. 5B to 5D are set in the memory 63 in advance, and the user is able to select the desired thinning pattern via a user interface (not shown). Here, the striped pattern (refer to FIG. 5B) is selected. Once the thinning pattern is selected, the widths of the lines and the intervals between the lines of the thinned out metallic image portion are set as the reference values. For example, with a striped pattern, the widths of the striped portions and the intervals between the stripes are set as the reference values. The reference values are changed according to the gradation values of the original image data in the next process (S312). Here, setting of the thinning conditions (S311) may be performed at the state immediately after the start of printing.

S312: Specifying of Thinning Portions

Next, the printer driver specifies portions (region of each virtual pixel) that become the thinning targets of the metallic image (S312).

Figure 9:
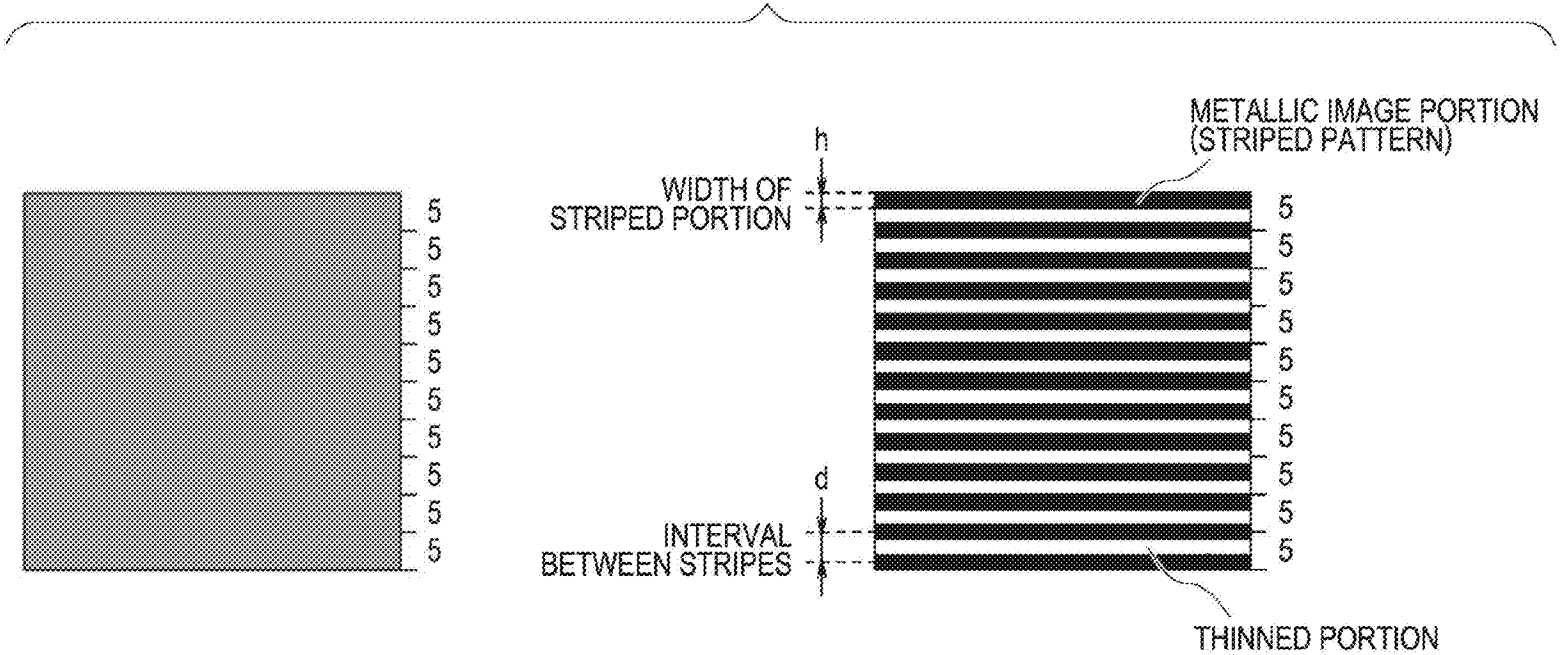
FIG. 9 is a diagram that describes a method of specifying the thinning portions for a metallic image in a case when the entire region has intermediate gradations.
Figure 10:
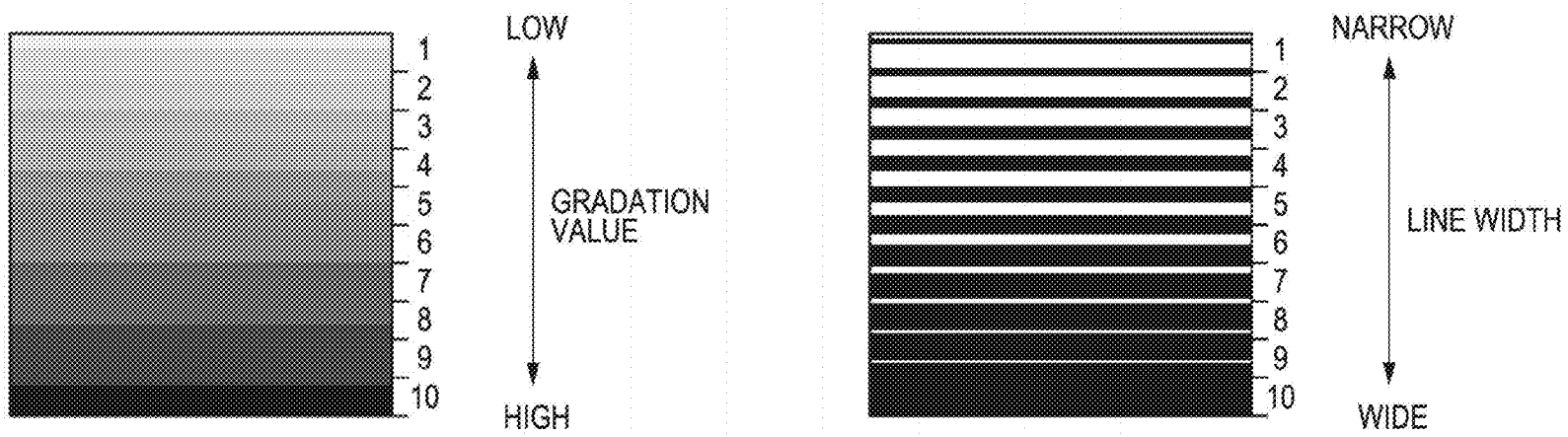
FIG. 10 is a diagram that describes a method of specifying the thinning portions for a metallic image in a case when the gradation values change gradually.
Figure 11:
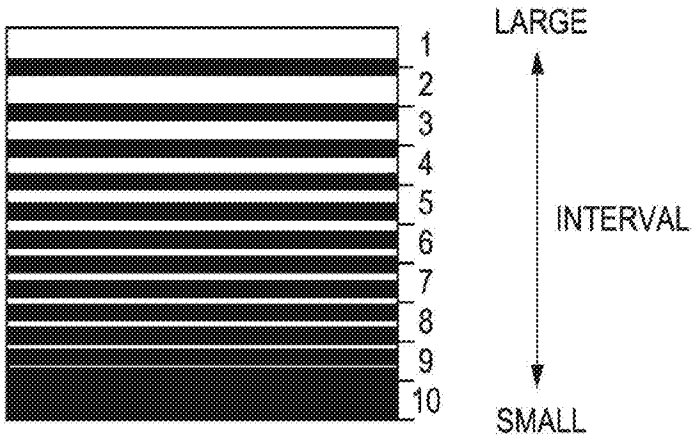
FIG. 11 is a diagram that describes another method of specifying the thinning portions for a metallic image in a case when the gradation values change gradually.
Figure 11:
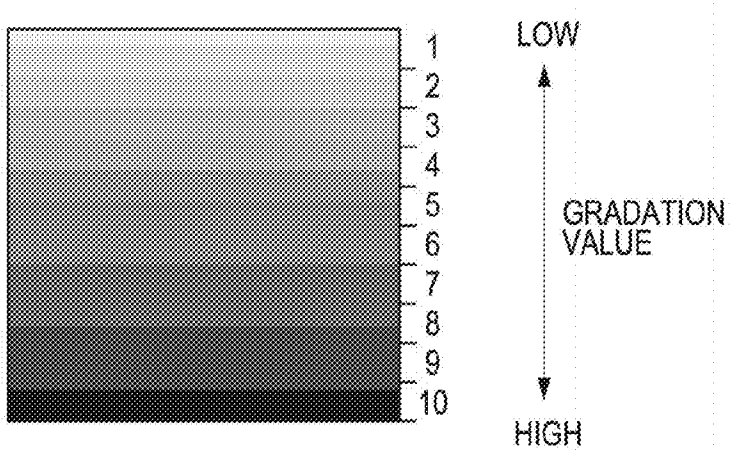

The specifying of the thinning portions is performed based on the gradation values of each of the pixels (virtual pixels) that are instructed by the original image data of the metallic image with the thinning pattern set in S311 as the reference. Diagrams that describe a method of specifying the thinning portions are illustrated in FIGS. 9 to 11. The diagram on the left side of each of FIGS. 9 to 11 represents the original image of the metallic image (rectangular image) as the printing target. The numbers on the right end of each row of the original image indicate the gradation value of the row. On the other hand, the diagram on the right side of each of FIGS. 9 to 11 illustrates image data in a state in which the dots are thinned out in a striped pattern by a thinning process. As with the diagrams on the left side, the numbers written on the right end for each row indicate the gradation values in the row.

Here, for the sake of description, the metallic image has ten gradations.

FIG. 9 illustrates an example of a metallic image in a case when the entire region has an intermediate gradation (gradation value 5). That is, as illustrated by the original image on the left side, an example of a metallic image in which metallic ink is injected evenly over the entire rectangular region and the entire image is in a state of being daubed over is illustrated. In a case when generating thinning data for such an image, the printer driver specifies the thinning portions so that the dots are thinned out with even widths and intervals as illustrated to the right side of the drawing. Here, the width of the lines of the striped portions of the metallic image of the drawing on the right side of FIG. 9 is h, and the interval between the lines (distance between the centers of lines) is d (reference value). A method of recreating a gradation expression of the metallic image will be described below with such a state of FIG. 9 as the reference state.

FIGS. 10 and 11 illustrate examples of images of metallic image with the same outline (rectangle) as in FIG. 9 in which the gradation value gradually increases toward the bottom of the images. That is, FIGS. 10 and 11 are examples of metallic images in which the gradations (gradual change in the shading) are expressed. In the images, the gradation values are lowest at the top portions (gradation value 1) and the gradation values are the highest at the bottom portions (gradation value 10).

In a case when such gradations are to be expressed by thinning out the dots of the metallic image in a striped pattern, there is a method of changing the width h of the lines of the striped portions of the metallic image and a method of changing the interval d between the lines of the striped portions.

In FIG. 10, the gradations are expressed by a method of fixing the interval d and changing the line width h. In the drawing, the dots are thinned out for each of the virtual pixels so that the size of the line width h of the metallic image changes according to the gradation values of the original image (drawing on the left side). That is, the dots are thinned out so that the greater the gradation value, the greater the value h, and the lower the gradation value, the smaller the value h. For example, dot thinning is hardly performed at all for the bottom portions that indicate the highest gradation (gradation value 10) so that the line width h becomes the widest. On the other hand, many dots (pixel data) are thinned out for the top portions that indicate the lowest gradation (gradation value 1) so that the line width h becomes the narrowest. Furthermore, for the central portion that indicates an intermediate gradation (gradation value 5), the dots (pixel data) are thinned out so that the line width h is the same as that illustrated in FIG. 9.

In so doing, by changing the size of the region onto which the metallic ink is ejected (thickness of the lines) for each portion of the image according to the gradation values of the original image, the metallic ink amount is adjusted and a free gradation expression is performed. That is, gradation expression is performed by changing the amount of metallic ink that is ejected per unit area by adjusting the balance between portions onto which the metallic ink is ejected and portions onto which the metallic ink is not ejected (portions that become blank when printing).

Here, as described above, in order to form an image with a metallic luster, it is necessary for the metallic image portion to have a region of a minimum size (for example, 1 $mm^2$). Therefore, even in a case when the minimum gradation value is expressed, the lower limit value of the line width must be the size of the virtual pixel set in S102 (for example, 24×24 dpi).

Next, FIG. 11 expresses gradation by a method of fixing the line width h and changing the interval d between the lines.

In the drawing, the dots are thinned out so that the interval d between the lines of the metallic image changes according to the gradation values of the original image (drawing on the left side). That is, the dots are thinned out so that the greater the gradation value, the smaller the value d, and the lower the gradation value, the greater the value d. For example, dot thinning is hardly performed at all for the bottom portions that indicate the highest gradation (gradation value 10) so that the interval d becomes the smallest. On the other hand, many dots are thinned out for the top portions that indicate the lowest gradation (gradation value 1) so that the interval d becomes the greatest. Furthermore, for the central portion that indicates an intermediate gradation (gradation value 5), the dots are thinned out so that the interval d is the same as that illustrated in FIG. 9.

In so doing, by changing the intervals by which the metallic ink is ejected for each portion based on the gradation values of pixel data of the metallic image, the metallic ink amount is adjusted and a free gradation expression is performed. That is, similarly to the case of FIG. 10, gradation expression is performed by changing the amount of metallic ink that is ejected per unit area by adjusting the balance between portions onto which the metallic ink is ejected and portions onto which the metallic ink is not ejected (portions that become blank when printing).

Further, a method of adjusting the thinning amount while combining and changing the line width h and the interval d is also possible. Even in such a case, the amount of metallic ink that is ejected per unit area in such a portion is changed based on the gradation values of the original image. By combining and changing the line width h and the interval d, a more precise gradation expression becomes possible.

Although a striped thinning pattern is exemplified in FIGS. 9 to 11, the method of specifying the thinning portions is the same in the case of the lattice or checkered thinning patterns illustrated in FIGS. 5C and 5D. That is, the width of the lines and the intervals between the lines that are formed in a region by metallic ink are adjusted according to the gradation values of a certain region of the original image. It is possible to free express gradations with a metallic image while maintaining a metallic luster by adjusting the ink amount that is ejected per unit area of the medium by adjusting the width of the lines or the interval of the lines.

S313: Thinning Process

The gradation value of Me of the virtual pixels that are specified as the portions that are the thinning targets in S312 is changed to zero. In so doing, metallic print data composed of a virtual pixel row for which the Me gradation value is not zero (virtual pixel row to which the metallic ink is ejected) and a virtual pixel row for which the Me gradation value is zero (virtual pixel row that is specified as the thinning target) is obtained.

Effects of First Embodiment

In the first embodiment, the amount of metallic ink that is ejected per unit area is changed by thinning out the metallic ink dots based on the gradation values of the pixels that configure the metallic image. At this time, the dots are thinned out so that the region to which the metallic ink is ejected becomes equal to or greater than a predetermined width.

In so doing, it becomes possible to realize a gradation expression freely for the metallic image while forming a metallic image with a favorable metallic luster when performing metallic printing.

Second Embodiment

In the second embodiment, when forming a metallic image by metallic ink (Me) and a color image by color ink (KCMY) at the same time in metallic printing, printing is performed so that there are portions where the metallic image and the color image overlap. The configuration of the printer used for the printing is the same as in the first embodiment.

Printing Target Image

Figure 12:
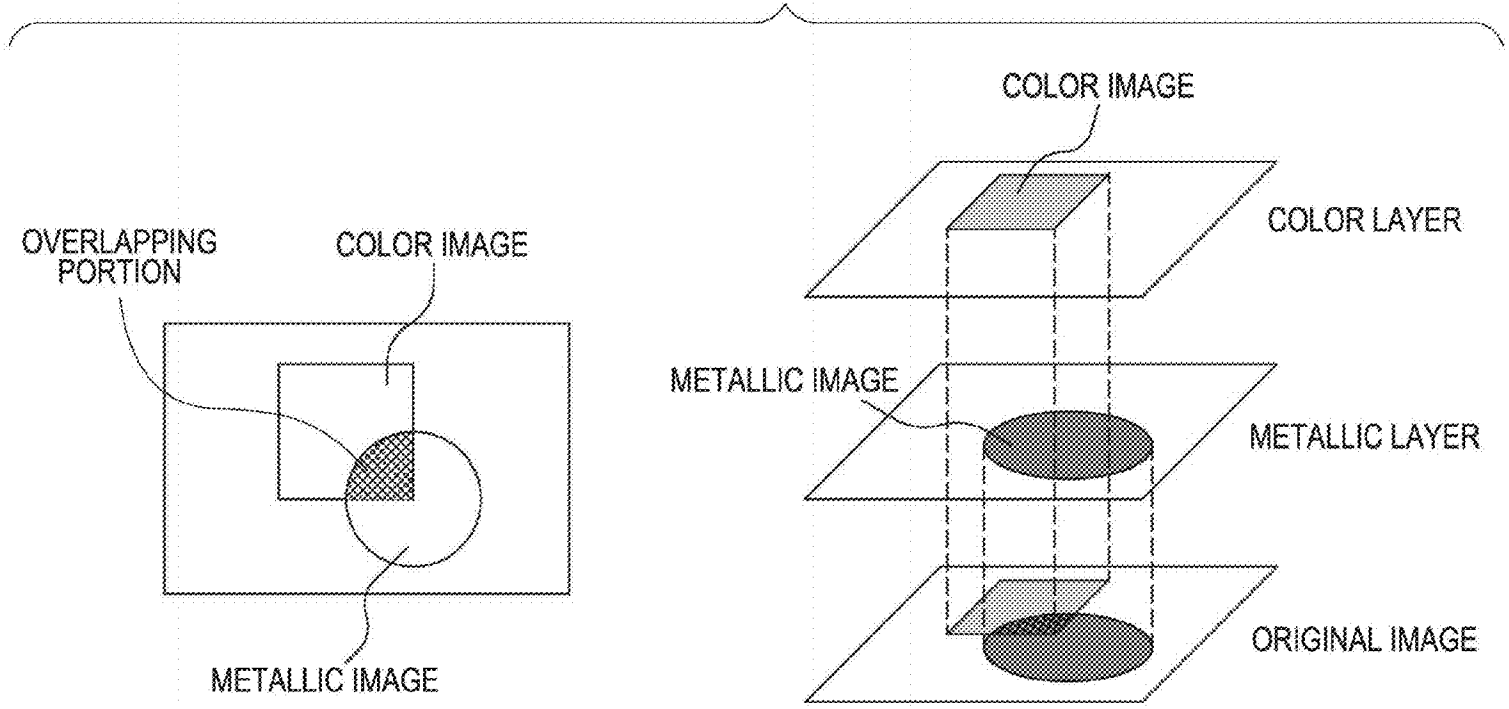
FIG. 12 is an outline diagram of an image that is the printing target according to a second embodiment.

An outline diagram of an image that is the printing target in the second embodiment is illustrated in FIG. 12. As illustrated in the drawing on the left side of FIG. 12, an image (original image) that becomes the printing target in the embodiment includes a metallic image portion (circular portion) that is printed with metallic ink and a color image portion (rectangular portion) that is printed with color ink. Furthermore, the image is configured so that both images overlap on the region represented by the shaded portion. Here, the color image is represented by the three colors of RGB (RGB respectively represents each color of red (R), green (G), and blue (B)), and during printing, the color image is printed by color ink of the four colors of KCMY (KCMY respectively represents each color of black (k), cyan (C), magenta (M), and yellow (Y)).

For the sake of description, the original image is considered to be divided into two levels of a level on which the metallic image is formed (metallic layer) and a level on which the color image is formed (color layer). Here, while the color layer is actually able to be divided into images with the three colors of RGB, below, the color layer will be described as being configured by a color image of one color. As illustrated in the drawing on the right side of FIG. 12, an image (original image) that is the printing target is formed by overlapping the metallic layer and the color layer.

In a case when there is a region in which the color image and the metallic image overlap, first, the metallic image is formed on the medium by first performing printing of the metallic layer. Furthermore, a method of overlapping a color image that is shown by a color layer over the metallic image after forming the metallic layer is common. By performing printing in such a manner, it is possible to express a metallic color (for example, metallic blue, metallic red, and the like) on the overlapping portion between the color image and the metallic image.

On the other hand, in the embodiment, printing is performed so that the metallic ink and the color ink are not ejected onto the same pixels in the overlapping portion. That is, printing is performed in which the metallic ink dots and the color ink dots that are formed on the medium do not overlap at the pixel unit.

With common metallic printing, since the metallic image and the color image are formed in order, there is a need to sufficiently dry the image that is formed first before forming the next image, making the time taken to complete printing long. However, with the embodiment, by ejecting ink so that the ink dots do not overlap one another in the overlapping portion of the metallic image and the color image, it is possible to form the metallic image and the color image at the same time in one printing operation. In so doing, it is possible to shorten the time taken to print compared to the related art.

Image Processing of Metallic Image

The basic flow of performing image processing of the metallic image is similar to the description of the first embodiment in FIG. 6. However, with the embodiment, since the ink dots are made to not overlap one another in the overlapping portion (hereinafter also referred to as the overlapping region) of the color image and the metallic image, the processes of the thinning data generation process (S103) are different. The thinning data generation process (S103) in the overlapping portion will be described below centered on the differences with the embodiment described above.

Details of Thinning Data Generation Process in Overlapping Region

As described above, in the embodiment, simultaneous printing of the metallic image and the color image is realized by making the metallic ink (Me) and the color ink (KCMY) not be ejected onto the same pixels on the medium in the overlapping region of the metallic image and the color image. There is therefore a need to thin out the print data of the color ink dots for pixels onto which metallic ink dots are due to be ejected, and conversely to thin out the print data of the metallic ink dots for pixels onto which color ink dots are due to be ejected.

Figure 13:
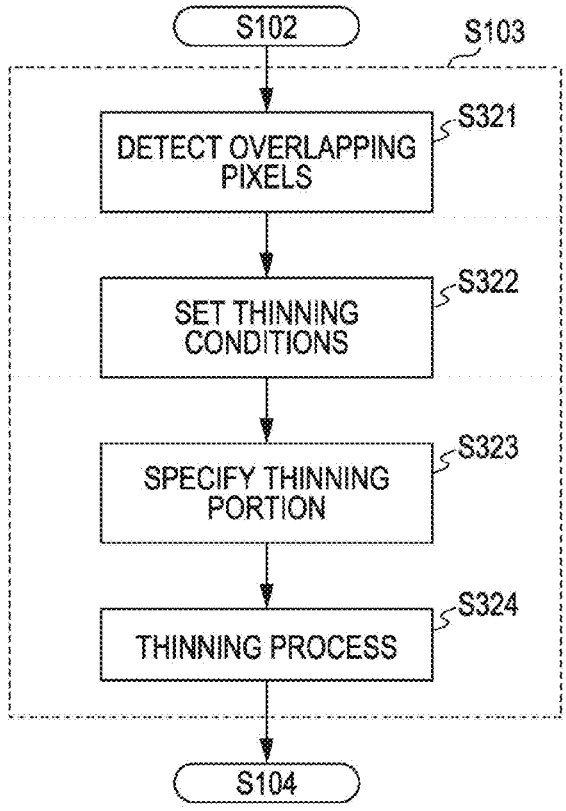
FIG. 13 is a diagram that represents the flow of a thinning data generation process according to the second embodiment.

The flow of the specific processes of the thinning data generation process according to the second embodiment is illustrated in FIG. 13. The thinning data generation process (S103) is performed by sequentially executing each of the processes of S321 to S324.

First, detection of an overlapping region (overlapping pixels) is performed (S321) by determining whether or not there is an overlapping region of the metallic image and the color image in the original image data. Even if the original image includes a metallic image and a color image, if a region (pixels) that overlaps each other is not detected, similarly to the first embodiment, a thinning data generation process is performed only for the metallic image portion. On the other hand, in a case when there are overlapping pixels, a process for thinning out predetermined dots of the respective image data of the metallic image and the color image after such a region is detected.

Here, the metallic image and the color image "overlapping" refers to a case when the positions of the pixels that indicate the metallic image in the metallic layer (pixels for which the gradation value is not zero in terms of Me) and the positions of the pixels that indicate the color image in the color layer (pixels for which the gradation value is not zero in terms of at least one of the colors of KCMY) overlap one another. For example, if the Me gradation value is 128 and the Y gradation value is 256 for a given pixel A, the metallic image and the color image are overlapping for the pixel A. Further, if the Me gradation value is 64 and the KCMY gradation values are all 0 for a given pixel B, the metallic image and the color image are not overlapping for the pixel B.

The printer driver performs detection of overlapping pixels of the metallic image and the color image by comparing the gradation value of Me and the gradation value of KCMY for each pixel from the metallic image data and the color image data. In a case when overlapping pixels are detected, the positional information of the overlapping pixels are temporarily saved in the memory 63, and the process proceeds to the setting of the thinning conditions (S322) that is the next process.

The same dot thinning conditions as S311 in FIG. 8 described above are set for the metallic image portion of the detected overlapping region (S322). Here, the setting of the thinning conditions may be performed at the start of printing.

In the second embodiment, specifying of the pixels that are the thinning targets is performed for each of the metallic image data of the metallic layer and the color image data of the color layer (S323), and the thinning process of the image data is actually performed (S324). Predetermined pixels (virtual pixels) out of the pixels (virtual pixels) that configure the overlapping region detected in S321 become the thinning targets. The specifying of the thinning target portion with regard to the metallic image data is the same as in the first embodiment, and the amount of metallic ink that is ejected per unit area is adjusted based on the gradation values of the original image. For example, in a case when dots are thinned out as a striped pattern, the line widths of the striped portions are made thin and the intervals between the stripes are widened for regions of the original image in which the gradation values are small.

In addition, in the embodiment, since print data in which the metallic ink and the color ink are not ejected onto pixels in the same position in an overlapping manner is generated, it is necessary to thin out pixels at positions that differ between the metallic image data and the color image data. For example, in a case when a virtual pixel C at a predetermined position within an overlapping region with a color image in a metallic image is specified as a thinning target, there is no need to thin out a pixel C' at the same position in the color image. Similarly, in a case when a virtual pixel D at a predetermined position within an overlapping region with a metallic image in a color image is specified as a thinning target, there is no need to thin out a virtual pixel D at the same position in the metallic image. That is, if it is possible to specify the pixels that become the thinning target for the image of either the metallic image or the color image, it is possible to specify the pixels that become the thinning target for the other image.

Figure 14A:
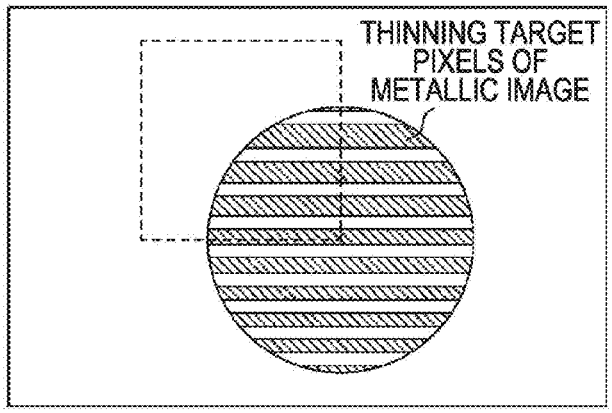
FIGS. 14A to 14C are diagrams that describe a method of specifying thinning pixels in a striped pattern according to the second embodiment.
Figure 14B:
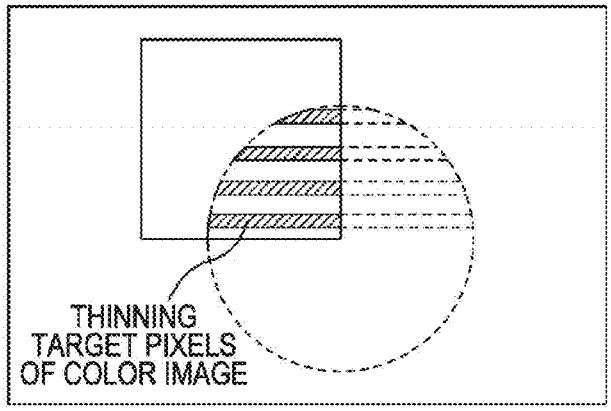
Figure 14C:
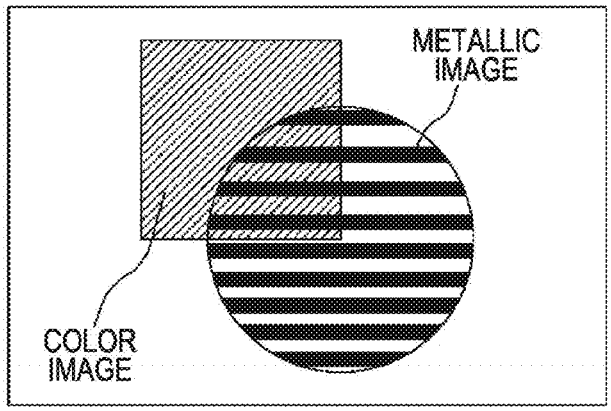

Here, an example of a case when the print data of a striped thinning pattern is generated will be described. FIGS. 14A to 14C are diagrams that describe a method of specifying the thinning pixels in a striped pattern.

FIG. 14A is a diagram that specifies the thinning target pixels of the metallic image. Similarly to S312 of FIG. 8, the printer driver specifies the virtual pixels that are the thinning target while changing the dot thinning amount for each region according to the gradation values of the metallic image data for each of the virtual pixels that configure a region that overlaps the color image in the metallic layer. As a result, out of the metallic image illustrated in FIG. 14A, the portions represented by the diagonal lines are specified as the thinning target pixels of the metallic image.

Next, for each of the pixels that configure a region that overlaps the metallic image in the color layer, all pixels other than the virtual pixels that are specified as the thinning target in the metallic image (pixels specified by the diagonal line portions in FIG. 14A) are specified as the thinning target. The portions represented by the diagonal lines out of the color image illustrated in FIG. 14B are the thinning target pixels of the color image. In other words, all of the portions that are specified as virtual pixels onto which the metallic ink is ejected in the overlapping region are specified as the thinning target pixels of the color image. In so doing, color image data in which the overlapping region becomes a striped pattern (pattern in which the striped pattern of the metallic image is inverted) is obtained.

Furthermore, by combining such data, image data in which the positions of the virtual pixels onto which the metallic ink dots are ejected and the positions of the pixels onto which the color ink dots are ejected in the overlapping region do not overlap (FIG. 14C) is obtained.

A resolution conversion process (S104) and the like are then performed on the image data of the metallic image, and the final print data is generated. By respectively ejecting metallic ink and color ink according to the generated print data, an image in which the metallic image and the color image have an overlapping portion is printed.

Image Processing of Color Image

Here, image processing of the color image in the color layer will be briefly described for reference.

Figure 15:
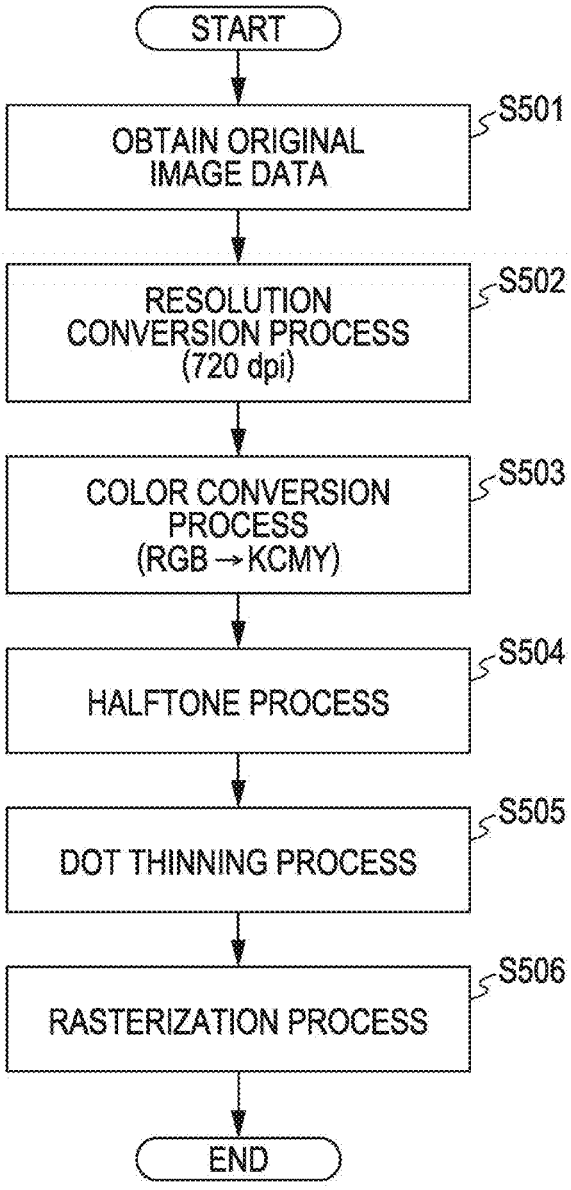
FIG. 15 is a diagram that represents the flow of image processing of a color image according to the second embodiment.

The flow of image processing of the color image is illustrated in FIG. 15. The image processing is performed by executing each of the processes of S501 to S506. Each process is executed based on an instruction from the printer driver.

The image processing of the color image differs from the image processing of the metallic image (refer to FIG. 6) in that the bitmap conversion process (S102) and the print resolution conversion process (S105) are performed at the same time as a resolution conversion process (S502), and further, a color conversion process (S503) and a halftone process (S504) are performed. The differences will be described below.

With the image processing of the color image, since there is no need to secure a metallic luster unlike with the metallic image, a minimum width of the image does not have to be set. There is therefore no need to convert the original image data into a resolution that is approximately 1 mm×1 mm as in the process of the metallic image processing (S102). Instead, conversion to a resolution of 720×720 dpi that is the print resolution is performed in the resolution conversion process (S502).

Further, a color conversion process is performed (S503) in order to represent the color image data that is configured by RGB by the color ink of KCMY. In so doing, the image data of the RGB color space is converted into image data of KCMY color space. The color conversion process of the color image is performed based on 3D-LUT in which the gradation values of the RGB data is associated with the gradation values of the KCMY data. The image data after the color conversion process is 8 bit data with 256 gradations that are represented by the KCMY color space. Here, since the metallic ink color (Me) is not able to be represented by the combination of KCMY and is treated as a special color, a color conversion process is not performed for the metallic ink (refer to FIG. 6).

The halftone process (S504) is a process of converting data with a high gradation number into data with gradation numbers which a printer is able to form. For example, data that shows 256 gradations is converted by the halftone process into 1 bit data that shows two gradations or 2 bit data that shows four gradations. A dither method, γ correction, an error diffusion method, or the like is used as the halftone process. In halftone processed image data, pixel data of 1 bit or 2 bits corresponds to each pixel, and the pixel data becomes data that indicates the dot formation situation (presence of dot, size of dot) for each pixel.

Furthermore, a dot thinning process of thinning out a portion of the pixel data is performed (S505) for the data after a halftone process (S504). As described above, in the dot thinning process, the pixels onto which the metallic ink is due to be ejected are specified as the thinning target pixels of the color ink in overlapping portions with the metallic image, and the gradation values of the specified pixels are changed to zero.

Other basic processes and flow are the same as the image processing of the metallic image. Furthermore, the color image is formed by ejecting the color ink from the head 41 based on the print data that is finally generated.

Effects of Second Embodiment

In the second embodiment, in a case when performing overstrike printing in which there are portions where the metallic image and the color image overlap, the color ink dots and the metallic ink dots are made to not be ejected onto the same pixels. Furthermore, in the metallic printing portions, gradation expression of a metallic image is performed by adjusting the dot thinning amount according to the gradation values while maintaining the minimum width.

According to the printing method of the embodiment, metallic colors such as metallic blue are able to be expressed freely with gradation values by a metallic image with a favorable metallic luster. Furthermore, even in a case when the metallic image and the color image overlap, printing of the metallic image and printing of the color image are able to be performed at the same time. In so doing, it is possible to print a high quality metallic image with a shorter print time than metallic printing of the related art.

Third Embodiment

In the third embodiment, a higher quality metallic image is formed by changing the method of the image processing of the outline portion when forming a metallic image in metallic printing.

As described above, with a metallic image, the bitmap data for printing is generated with a resolution (for example, 24×24 dpi) for securing the minimum size of a region onto which the metallic ink is to be ejected (S102 of FIG. 6). Furthermore, during actual printing, the metallic ink is ejected to form regions of a size that is approximately 1 $mm^2$. That is, the metallic image is formed in units of rectangular dots with a size that is approximately 1 $mm^2$. In such a case, since the outline of the metallic image is also formed by 1 $mm^2$ dots, even if the outline portion of the original image data is a smooth curve, the outline portion of the image that is actually printed appears jagged, giving the impression that the image has deteriorated.

Figure 16:
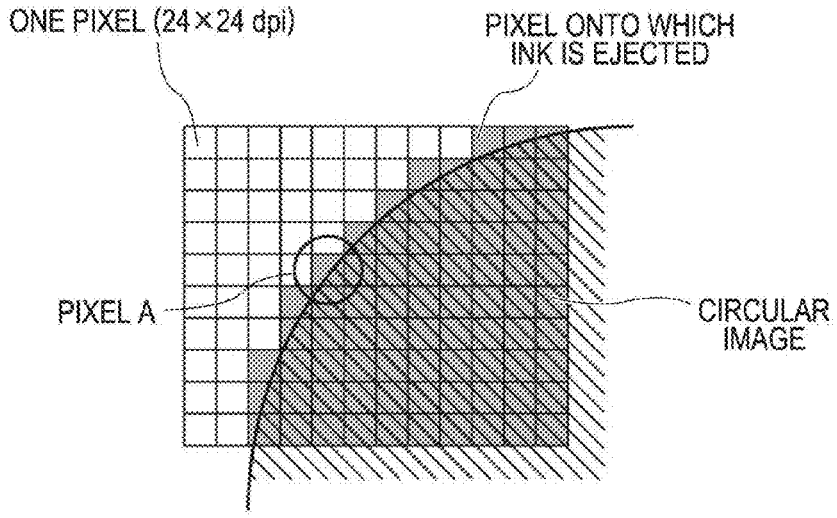
FIG. 16 is a diagram that illustrates an example in a case when a circular metallic image is printed in which a portion of the image is shown with a resolution of 1 mm×1 mm (approximately 24 dpi).
Figure 17:
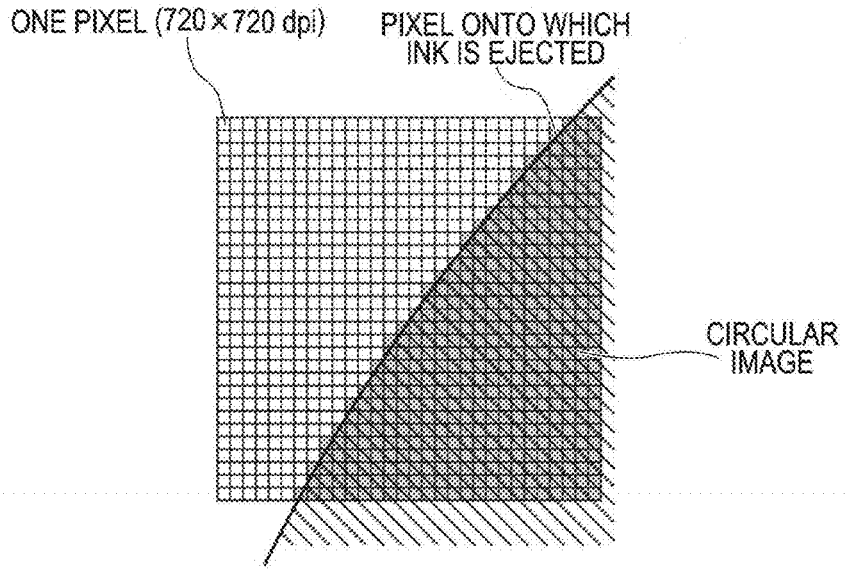
FIG. 17 is a diagram that illustrates an example in a case when an image of the same shape as in FIG. 16 is printed in which a portion of the image is shown with a resolution of 720×720 dpi.

Diagrams that specifically describe the state of dot formation in the outline portion of the metallic image are illustrated in FIGS. 16 and 17.

FIG. 16 is an example in which in a case when a circular metallic image is printed, a portion of the image is represented with a resolution of 24×24 dpi (approximately 1 mm×1 mm). Each square of a region that is represented by a grid pattern in the drawing respectively represents one pixel (24×24 dpi). Furthermore, the portion represented by the shaded portion indicates the circular metallic image (original image) that is the printing target, and the color pixels indicate pixels onto which the metallic ink is ejected (metallic ink dots are formed) during printing.

As illustrated in FIG. 16, the minimum unit (unit pixels) of the metallic image that is formed by metallic ink is a relatively large region of approximately 1 mm×1 mm. Therefore, the range within which the metallic image is actually formed (colored pixel range) is greater than the range indicated by the image data (shaded range). As a result, the metallic ink at the outline portion of the metallic image appears to spill out in a jagged manner as in FIG. 16, and a rough image with so-called jaggies is formed.

On the other hand, FIG. 17 is an example in which in a case when an image with the same shape as FIG. 16 is printed, a portion of the image is represented by a resolution of 720×720 dpi. Here, the region represented by FIG. 17 is equivalent to the portion of a pixel A in FIG. 16. Each square of the region represented by squares in FIG. 17 respectively represents a pixel (720×720 dpi). Furthermore, the portion represented by the shading indicates the circular image (original image) that is the printing target and the colored pixels indicate the range of the image in a case when ink is ejected (dots are formed) with a resolution of 720 dpi. If the ink is ejected in an ideal manner, as illustrated in the drawing, the range designated by the image data of the original image and the range within which the ink is actually ejected become approximately the same shape.

If it is possible to eject the ink in such a manner, since the spilling out of the ink from the outline portion of the image is at a level that cannot be seen by the naked eye and the jaggedness does not stand out either, it is possible to maintain a favorable image quality. That is, at the outline portion of the image, the pixel data that represents the state of the pixel A of FIG. 16 may be converted into pixel data that represents the state of FIG. 17. The metallic ink dots to be formed on the pixels at the uncolored portions of FIG. 17 are therefore thinned out from the metallic image data of the state of FIG. 16.

Image Processing of Metallic Image

Figure 18:
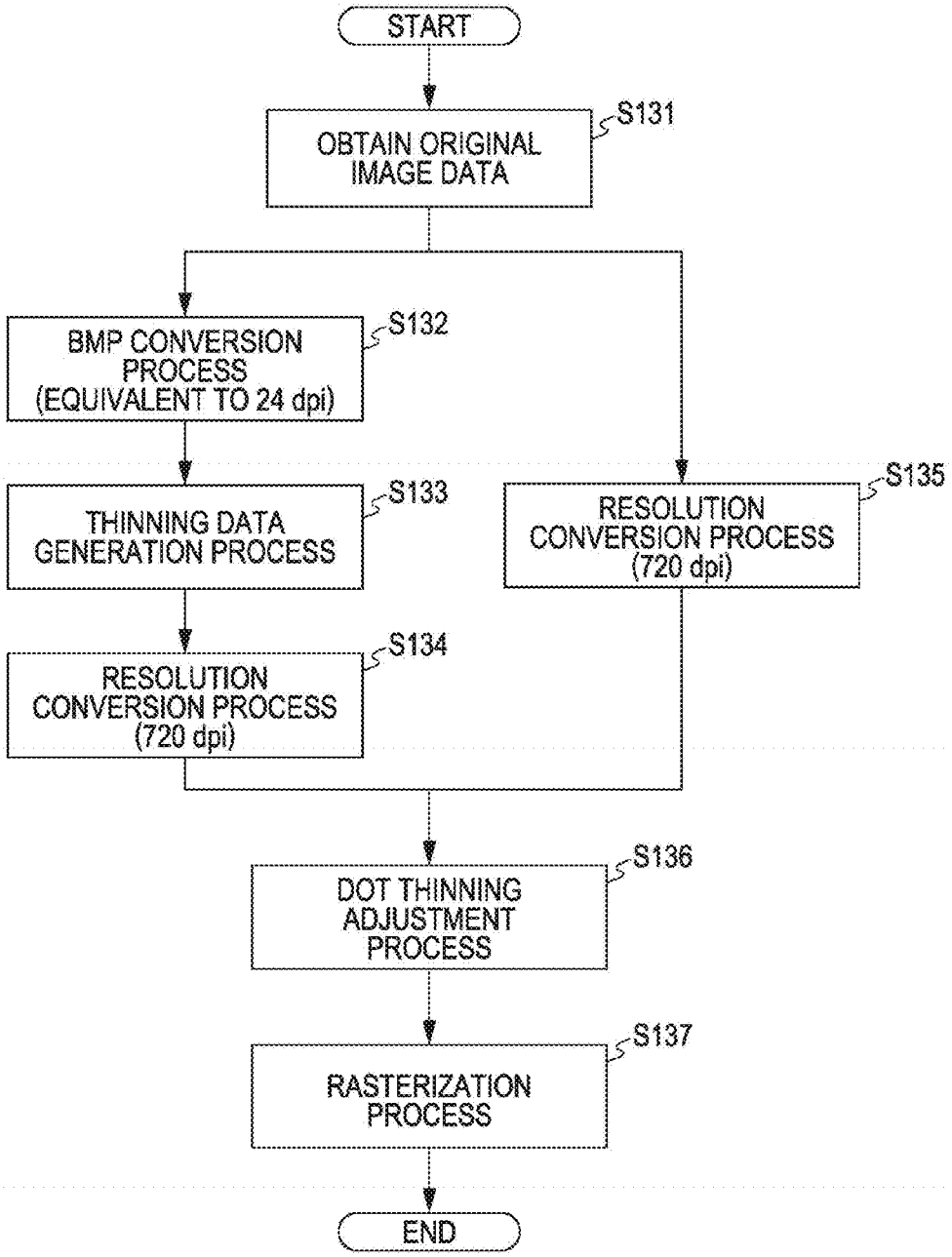
FIG. 18 is a diagram that represents the flow of image processing of a metallic image according to a third embodiment.

In the embodiment, image processing of thinning out pixel data that spills out from the outline portion of the metallic image is performed. The flow of the image processing of the metallic image according to the third embodiment is illustrated in FIG. 18.

In the embodiment, the image processing is performed by executing each of the processes of S131 to S137. S131 to S134 and S137 are respectively the same processes as S101 to S104 and S105 of the first embodiment. The embodiment differs from the first embodiment in that a resolution conversion process (S135) and a dot thinning adjustment process (S136) are performed.

S135: Resolution Conversion Process

The printer driver copies the obtained original image data and converts the copy image into 720×720 dpi data. In so doing, the pixel data represented by FIG. 17 described above is obtained. The pixel data is then temporarily saved in the memory 63.

S136: Dot Thinning Adjustment Process

Figure 19:
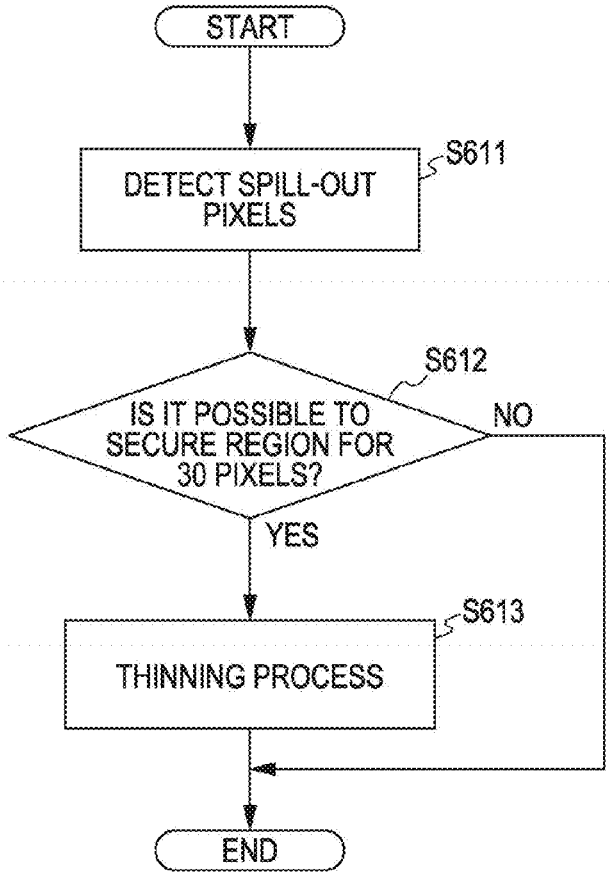
FIG. 19 is a diagram that represents the flow of processes that are performed in a dot thinning adjustment process (S137).

The flow of the process that is performed in the dot thinning adjustment process (S136) is illustrated in FIG. 19.

The printer driver compares the data of which the resolution is converted into 720 dpi in S134 (pixel data that is equivalent to the state of FIG. 16) and the data of the original image of which the resolution is converted into 720 dpi in S135 (pixel data that is equivalent to the state of FIG. 17) and performs detection of the pixels that spill out (S611). Here, pixels other than in portions in which two types of image data overlap are detected as the "pixels that spill out" of the metallic ink. Specifically, pixels in which the gradation values of Me are not zero for data obtained in S134 and in which the gradation values of Me are zero for data obtained in S135 are detected as the "pixels that spill out".

Next, determination of the size of the metallic image is performed (S612). By thinning out the metallic ink dots that are formed on the "pixels that spill out" that are detected in S611, spilling out of the metallic image is suppressed, and it is possible to form an image of the state of FIG. 17. On the other hand, if the size of the metallic image becomes smaller than 1 $mm^2$ by thinning out the metallic ink dots, there is a concern that it is not possible to maintain a metallic luster. Therefore, in a case when the dots of the detected "pixels that spill out" are thinned out, determination of whether or not the thinned out metallic image is able to secure a continuous region for a predetermined number of pixels is performed. For example, whether or not it is possible to secure a continuous region for 30 pixels as the number of pixels which is equivalent to the region of a width of 1 mm is determined.

Furthermore, in a case when it is determined that it is possible to secure a continuous region for a predetermined number of pixels, the gradation values of Me of the "pixels that spill out" are changed to zero and the excess metallic ink dots are thinned out (S613). In so doing, jaggies of the metallic image are eliminated.

On the other hand, in a case when it is not possible to secure a continuous region for 30 pixels, the dot thinning adjustment process (S136) is ended without performing dot thinning for the pixels that spill out in order to prioritize the maintenance of a metallic luster and the process proceeds to the next rasterization process (S137).

Effects of Third Embodiment

In the third embodiment, an image that is closer to the original image data is printed by thinning out the metallic ink dots that are formed spilling out from the outline portion of the metallic image. At such a time, the dots are thinned out so that the metallic image is able to secure a minimum width (1 mm).

In such a manner, it is possible to perform high quality metallic printing in which jaggies and the like do not easily occur on the outline portion while maintaining a favorable metallic luster.

Fourth Embodiment

In the fourth embodiment, the manner in which the metallic ink dots are thinned out is changed taking "the angle at which the image is viewed" when the user views the printed metallic image into consideration.

Angle at which Metallic Image is Viewed

When the user views a metallic image in a state in which the dots are thinned out, there is a case when the manner in which the image appears changes depending on the viewing angle. For example, when a metallic image in which the metallic ink dots are thinned out in a horizontal striped pattern as formed in each of the embodiments described above is viewed diagonally from below, the metallic luster appears differently between the upper portion and the lower portion.

Figure 20A:
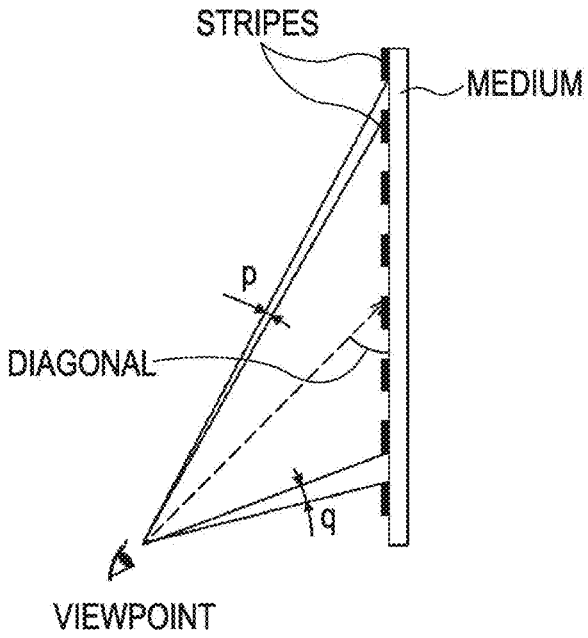
FIG. 20A is a diagram that represents the relationship between an observation target image and the viewpoint when viewing the image (in a case when the line of view is diagonal with respect to the image).
Figure 20B:
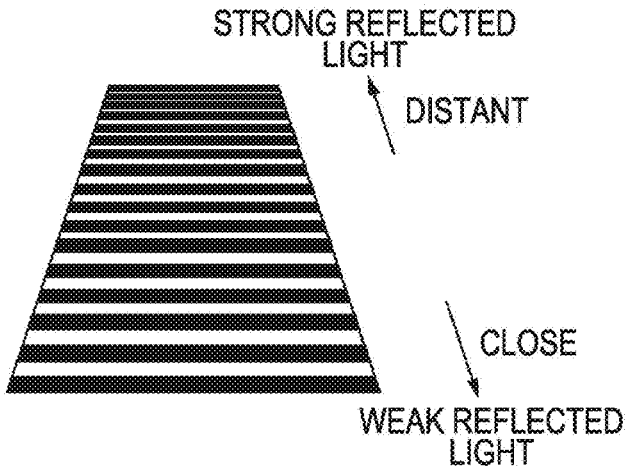
FIG. 20B represents the image that is actually perceived.

A diagram that describes the manner in which an image appears in a case when an image is observed from a diagonal angle is illustrated in FIGS. 20A and 20B. FIG. 20A represents the relationship between the observation target image and the viewpoint when the image is viewed and FIG. 20B represents the state of the image that is actually perceived. That is, FIG. 20B represents the state of the image that is perceived in a case when the vicinity of the center of the image is viewed from a viewpoint so as to view upward from below with the line of view diagonal with respect to the image. In a case when the image is viewed diagonally from below, the angle between the line of view and the image becomes smaller toward the upper portion of the image. Therefore, as illustrated in FIG. 20A, the angle that is perceived as the intervals of the striped pattern is also perceived to be narrow to the upper side of the image (angle p of FIG. 20A) and wide at the bottom side of the image (angle q of FIG. 20A).

Here, in the embodiment, an image is formed using metallic ink that reflects light. In a case when "light" is perceived by the human eye, light appears to spread radially rather than as a dot (for example, a glare phenomenon that occurs in a case when light from illumination is viewed in the dark). Therefore, light that is reflected by the striped portions also appear to spread. At portions where the intervals between the stripes are narrow (portions that appear narrow) as at the top of the image, the intervals become hard to recognize with the naked eye due to the spread of reflected light, and the reflected light appears to be stronger than at the bottom of the image. The metallic luster and the feel of the image therefore appear to change between the top and bottom.

Such a phenomenon is more pronounced for larger images. The reason is that the larger the observation target image, the greater the differences in the distances from the viewpoint (differences in perspective). Therefore, in a case when viewing a giant advertising banner that is posted on the side of a building outdoors, the luster and the feel of the metallic image appear deteriorated, posing a problem.

Therefore, in the embodiment, the metallic luster is made to appear even, even in a case when an image is viewed diagonally, by reducing the amount of metallic ink that is ejected per unit area for each region in which a medium on which the image is formed and the line of view when the image is viewed intersect. At this time, predetermined metallic ink dots are thinned out so that the image appears to have a horizontal striped pattern with respect to the line of view when the image is viewed diagonally. For example, when the image is viewed from a vertical angle, and metallic ink dots are thinned out to be horizontal, and when the image is viewed from a horizontal angle, the metallic ink dots are thinned out to be vertical.

Image Processing of Fourth Embodiment

Although the method of image processing is approximately the same as the first embodiment, a portion of the thinning data generation process (S103) in FIG. 6 is different.

Figure 21:
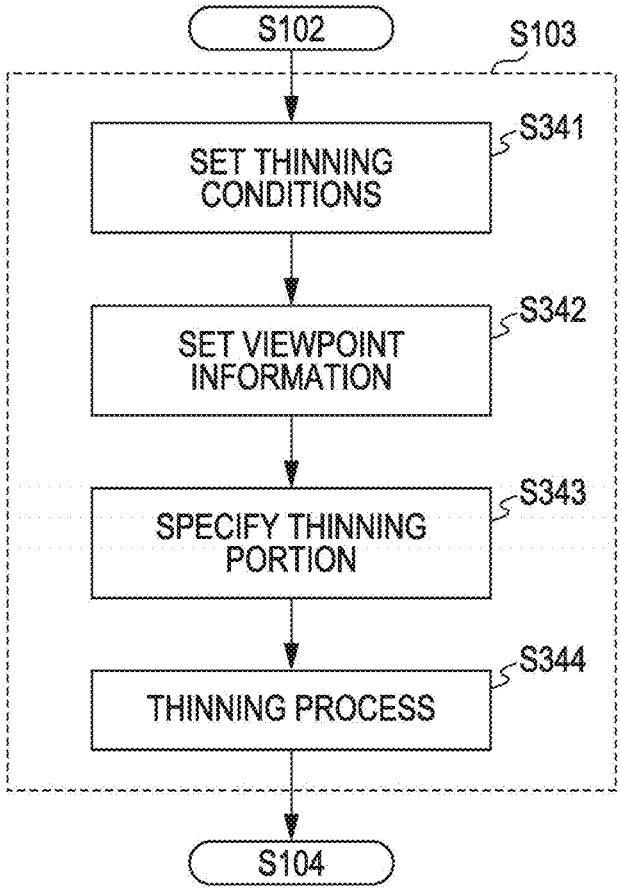
FIG. 21 is a diagram that represents the flow of a thinning data generation process according to a fourth embodiment.

The flow of the thinning data generation process according to the fourth embodiment is illustrated in FIG. 21. As described above, in the embodiment, a portion of the dots are thinned out for each of the pixels (virtual pixels) that configure the metallic image based on "the angle between the line of view of the user and the medium (image)", in other words, information that represents "the angle at which the image is viewed" (hereinafter also referred to as viewpoint information). In so doing, the amount of metallic ink that is ejected for each of the virtual pixels is adjusted and a metallic image with the optimum metallic luster according to the viewing angle is formed. Hereinafter, a specific method of the thinning data generation process in a case when the thinning pattern becomes a horizontal striped pattern as illustrated in FIG. 5B will be described.

First, the thinning conditions of the metallic ink dots are set similarly to S311 of FIG. 8 (S341).

Next, the viewpoint information is set by the user as the information that represents "the angle at which the image is viewed" (S342). In the embodiment, even in a case when a printed image is viewed from a diagonal direction, the dot thinning amount is changed according to the viewpoint information for forming a metallic image in which the metallic luster and feel appears similarly to the original image. Here, setting of the viewpoint information (S342) may be performed at a stage immediately after the start of printing or may be performed before the setting of the thinning conditions (S341).

Figure 22:
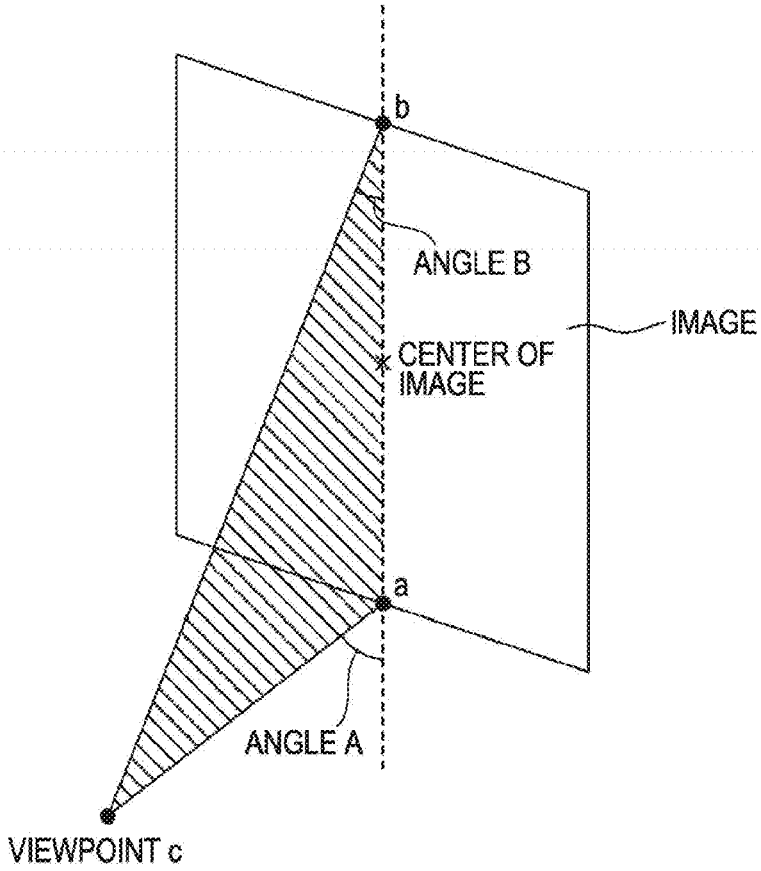
FIG. 22 is a diagram that describes setting of the viewpoint information.

A diagram that describes the setting of the viewpoint information is illustrated in FIG. 22. When the viewpoint is on a flat plane that passes through the center of the image as in the drawing, the portion of the image which is closest to the viewpoint (image bottom end in the drawing) in the vertical direction of the image is point a, the portion of the image which is furthest from the viewpoint (image top end in the drawing) is point b, and the viewpoint is point c. Further, the angle between a straight line that connects point c with point a (line of view) and the printing face of the image is A, and the angle between a straight line that connects point c with point b (line of view) and the printing face of the image is B.

The user sets the distance from point c to point a and the angle A or the distance from point c to point b and the angle B as viewpoint information via a user interface (not shown). Here, the distance between a and b is calculated from the original image data. In a triangle formed by point a, point b, and point c in FIG. 22 (triangle illustrated by shading), since two sides and the angle therebetween is clear, the positional relationship between the viewpoint when the image is viewed and the image is specified. The set viewpoint information is used in the specifying of the thinning portions in the next process (S343). Here, data other than that described above may be treated as viewpoint information if the data is able to specify the positional relationship between the viewpoint and the image. For example, the two angles of angle A and angle B may be set as the viewpoint information, or the angle between the distance from the viewpoint to the central portion of the image and the image may be set as the viewpoint information.

Next, the printer driver specifies the portions (virtual pixels) of the metallic image that become the thinning target (S343).

Although the specifying of the thinning portions is performed based on the gradation values of the original image with the thinning pattern set in S341 similarly to the first embodiment as the reference, in the embodiment, the dot thinning amount is further adjusted for every virtual pixel according to the viewpoint information set in S342. At this time, if the angle between the line of view and the image is small, the thinning portions are specified so that the amount of dot thinning in such a region increases. For example, in a case when performing dot thinning in a striped pattern for the image of FIG. 22, since the angle of point b is smaller than that of point a (A>B), adjustment is made so that point b has a greater dot thinning amount. Specifically, the dot thinning amount is adjusted by making the line widths of the striped portions at the point b thin and specifying the thinning pixels so that the intervals between adjacent stripes are widened.

Figure 23A:
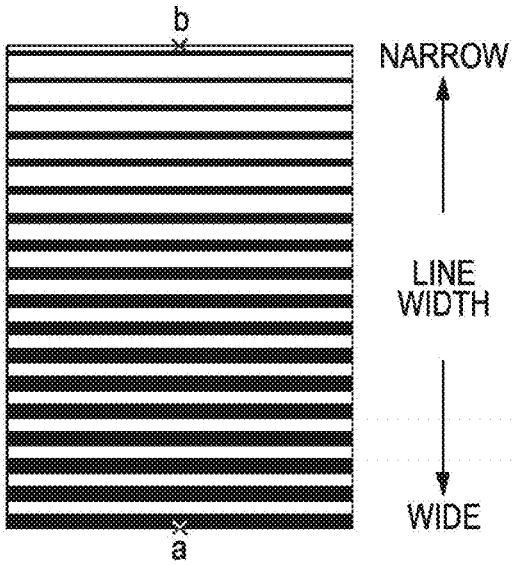
FIG. 23A is a diagram that represents an example of a metallic image in a case when the widths of dot thinning are changed based on the same viewpoint conditions as in FIG. 20A.
Figure 23B:
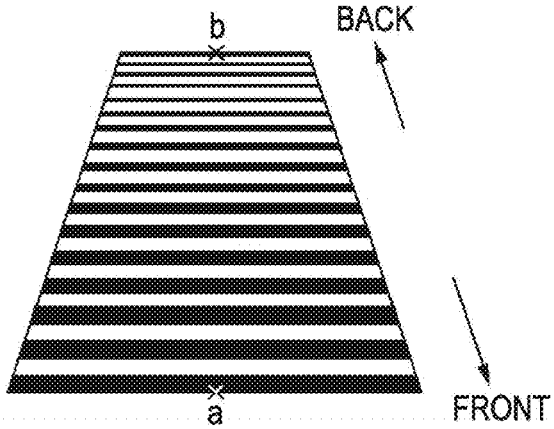
FIG. 23B is a diagram that represents the state of the image that is perceived in a case when the changed metallic image is actually viewed from such a viewpoint.

A specific example in a case when the line widths of the striped portions are changed according to the viewpoint information is illustrated in FIGS. 23A and 23B. FIG. 23A represents an example of a metallic image in a case when the dot thinning widths are changed based on the same viewpoint conditions as FIG. 20A. FIG. 23B represents the state of the image that is perceived in a case when the metallic image after being changed is actually viewed from the viewpoint. In the embodiment, the dot thinning amount is adjusted so that the size of the angle between the line of view and the image (for example, angle A or angle B in FIG. 22) and the line widths of the metallic image of such a portion after being thinned out are proportional. In FIG. 23A, since the further up the image from point a at the bottom end of the image, the smaller the angle between the line of view and the image, the dot thinning portions are specified so that the line widths of the metallic image in the higher regions of the image are also thinner. Furthermore, since the angle is the smallest at point b at the top end of the image, somewhat more dot thinning portions are specified so that the line widths become the smallest in such a region. Here, adjustment of the thinning amount is performed during viewpoint conditions in which the line of view with respect to the image becomes diagonal (refer to FIG. 20A) such as in a case when the image is viewed from below. Therefore, in a case when the angle between the line of view and the image is 90 degrees, adjustment of the line widths and the like is not necessary, adjustment of the dot thinning amount is not performed, and the dots are thinned out according to the thinning conditions set in S341.

As a result, as illustrated in FIG. 23B, compared to FIG. 20B, the image that is actually perceived appears to have wider intervals between the stripes of the image at the back portions (upper portions of the image). Since the differences in the intervals between the stripes between the front portions (lower portions of the image) and the back portions (upper portions of the image) are hard to perceive, the reflected light appears uniform, and the image as a whole appears to have an even metallic luster.

Figure 24A:
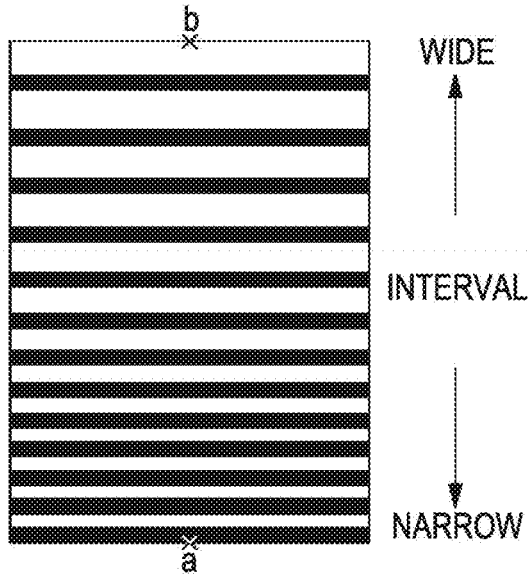
FIG. 24A is a diagram that represents an example of a metallic image in a case when the intervals of dot thinning are changed based on the same viewpoint conditions as in FIG. 20A.
Figure 24B:
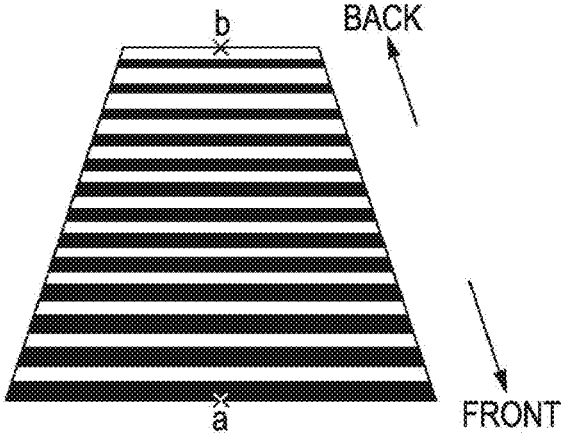
FIG. 24B is a diagram that represents the state of the image that is perceived in a case when the changed metallic image is actually viewed from such a viewpoint.

An example in a case when the intervals of the striped portions are changed according to the viewpoint information is illustrated in FIGS. 24A and 24B. FIG. 24A represents an example of a metallic image in a case when the dot thinning intervals are changed based on the same viewpoint conditions as FIG. 20A. FIG. 24B represents the state of the image that is perceived in a case when the metallic image after being changed is actually viewed from the viewpoint. In such a case, the dot thinning amount is adjusted so that the size of the angle between the line of view and the image (for example, angle A or angle B in FIG. 22) and the intervals between the lines of the metallic image of such a portion after being thinned out are inversely proportional. In FIG. 24A, since the further up the image from point a at the bottom end of the image, the smaller the angle between the line of view and the image, the dot thinning portions are specified so that the intervals between the lines of the metallic image in the higher regions are also thinner. Furthermore, since the angle is the smallest at point b at the top end of the image, somewhat more dot thinning portions are specified so that the line intervals become the smallest in such a region.

As a result, as illustrated in FIG. 24B, compared to FIG. 20B, the image that is actually perceived appears to have wider intervals between the stripes of the image at the back portions (upper portions of the image). Similarly to the case of FIG. 23, since the differences in the intervals between the stripes between the front portions (lower portions of the image) and the back portions (upper portions of the image)

are hard to perceive, the reflected light appears uniform, and the image as a whole appears to have an even metallic luster.

Here, in a case when a lattice pattern (FIG. 5C) or a checkered pattern (FIG. 5D) are set as the thinning pattern in S341, similarly to the line-like pattern described above, the line widths and the intervals are changed for the upper portions and the lower portions of the image (perspective direction when viewing the image).

In such a manner, the metallic ink amount that is ejected per unit area is adjusted by changing the thicknesses of the lines and the intervals between the lines at portions to which metallic ink is ejected according to the viewpoint information when the image is viewed, and a metallic image for which the metallic luster appears evenly when viewed from the viewpoint is formed. However, as described above, it is necessary for the metallic image portion to have a region of a minimum size (1 $mm^2$ in the example described above) in order to form an image with metallic luster. Therefore, even in a case when the line widths are changed as in FIG. 23A, the lower limit value of the line widths must be the width of the virtual pixel (1 mm in the example described above).

Furthermore, the gradation value of the metallic ink (Me) of the image data after the halftone process is changed to zero for the virtual pixels that are specified as the thinning target portions in S343 (S344). In so doing, metallic print data composed of a virtual pixel row for which the Me gradation value is not zero (virtual pixel row to which the metallic ink is ejected) and a virtual pixel row for which the Me gradation value is zero (virtual pixel row that is specified as the thinning target) is obtained.

Effects of Fourth Embodiment

In the fourth embodiment, while gradation expression is performed by thinning out predetermined dots from the metallic image, the manner in which the dots are thinned out is changed according to the angle at which the image is viewed. That is, the amount of metallic ink that is ejected per unit area is changed based on information that represents the angle between the line of view of the user when the image is viewed and the image. Further, the dots are thinned out so that the metallic image is able to secure a minimum width (1 mm).

In so doing, an image that has a favorable luster and in which the metallic luster appears evenly even in a case when the image is viewed diagonally is printed.

Other Embodiments

While printers and the like as embodiments have been described, the embodiments described above are for making the invention easy to understand, and are not to be interpreted as limiting the invention. Needless to say the invention may be modified and improved without departing from the gist thereof, and the invention includes any equivalents thereof. In particular, the embodiments described below are also included in the invention.

Ink to be Used

While examples of ink that include silver particles and aluminum particles as metallic ink have been described in the embodiments described above, the embodiments are not limited thereto. For example, it is also possible to use ink that includes other particles such as copper or gold as long as it is possible to realize a metallic luster when printing.

Further, while an example of recording using inks of the four colors of KCMY as the color ink has been described, inks other than KCMY such as light cyan, light magenta, white, and clear may be used to perform recording.

Piezo Elements

Although the piezo elements PZT were exemplified as elements that perform the actions for ejecting a liquid in the embodiments described above, other elements may be used. For example, a heater element or an electrostatic actuator may be used.

Printer Driver

The processes of the printer driver may be performed by the computer 110 (PC) as an external control apparatus or may be performed by the printer 1. Here, in a case when the processes are performed by the PC, the image forming apparatus is configured by the printer driver and a PC on which the printer driver is installed.

Other Image Forming Apparatuses

While the printer 1 of a type that moves the head 41 along with the carriage was exemplified in the embodiments described above, the printer may be a so-called line printer in which the head is fixed.

The entire disclosure of Japanese Patent Application No. 2011-047982, filed Mar. 4, 2011 is expressly incorporated by reference herein.

What is claimed is:

1. An image forming apparatus comprising: a head unit that ejects ink; and a control unit that forms a metallic image by causing metallic ink that includes metallic particles to be ejected onto a medium from the head unit, wherein the control unit reduces an amount of the metallic ink that is ejected per unit area of the medium by thinning out predetermined pixels out of pixels that configure the metallic image while causing the metallic image to have a predetermined width or greater, and wherein the control unit changes the amount of the metallic ink that is ejected per unit area of the medium based on gradation values of the pixels that configure the metallic image such that an amount of the pixels which are thinned out for regions of the metallic image with low gradation values is increased, and, wherein in a case when the pixels are thinned out so that the metallic image becomes a striped pattern, the control unit thins out the pixels so that widths of striped portions of the metallic image become thin or intervals between stripes of the metallic image become wide for regions of the metallic image with low gradation values.

2. The image forming apparatus according to claim 1, wherein the control unit forms a color image by causing color ink to be ejected onto the medium from the head unit, wherein in a case when there is a portion in which the color image and the metallic image overlap, pixels to which the color ink is ejected and pixels to which the metallic ink is ejected are made to not overlap.

3. The image forming apparatus according to claim 1, wherein the control unit thins out pixels that spill out from an outline of the metallic image out of the pixels that configure the metallic image.

4. The image forming apparatus according to claim 1, wherein the control unit reduces the amount of the metallic ink that is ejected per unit area in a region in which an angle between a surface of the medium and a line of view of the medium is small.

5. An image forming method comprising:

forming a metallic image by ejecting metallic ink that includes metallic particles from a head unit to a medium; and reducing an amount of the metallic ink that is ejected per unit area of the medium by thinning out predetermined pixels out of pixels that configure the metallic image while causing the metallic image to have a predetermined width or greater, changing an amount of the metallic ink that is ejected per unit area of the medium based on gradation values of the pixels that configure the metallic image such that an amount of the pixels which is thinned out for regions of the metallic image with low gradation values is increased, and in a case where the pixels are thinned out so that the metallic image becomes a striped pattern, thinning out the pixels so that widths of striped portions of the metallic image become thin or intervals between stripes of the metallic image become wide for regions of the metallic image with low gradation values.

6. An image forming apparatus comprising: a head unit that ejects ink; and a control unit that forms a metallic image by causing metallic ink that includes metallic particles to be ejected onto a medium from the head unit, wherein the control unit changes an amount of the metallic ink that is ejected per unit area of the medium based on gradation values of pixels that configure the metallic image while causing the metallic image to have a predetermined width or greater, and wherein the control unit reduces the amount of the metallic ink that is ejected per unit area in a region in which an angle between a surface of the medium and a line of view of the medium is small.

* * * * *